US010292436B2

(12) United States Patent
Cirillo et al.

(10) Patent No.: US 10,292,436 B2
(45) Date of Patent: May 21, 2019

(54) ELECTRONIC SMOKING SYSTEMS, DEVICES, AND METHODS

(71) Applicant: Arc Innovations Inc., San Francisco, CA (US)

(72) Inventors: Louis Cirillo, San Francisco, CA (US); Matt Kummer, San Francisco, CA (US)

(73) Assignee: ARC INNOVATIONS, INC., San Francisco, CA (US)

( * ) Notice: Subject to any disclaimer, the term of this patent is extended or adjusted under 35 U.S.C. 154(b) by 0 days.

(21) Appl. No.: 16/030,739

(22) Filed: Jul. 9, 2018

(65) Prior Publication Data

US 2019/0008208 A1 Jan. 10, 2019

Related U.S. Application Data

(60) Provisional application No. 62/530,725, filed on Jul. 10, 2017.

(51) Int. Cl.

| | |
|---|---|
| ***A24F 47/00*** | (2006.01) |
| ***A24D 1/14*** | (2006.01) |
| ***F23Q 3/00*** | (2006.01) |
| ***A24B 13/02*** | (2006.01) |
| ***A24F 7/04*** | (2006.01) |

(52) U.S. Cl.

CPC ..... *A24F 47/008* (2013.01); *A24B 13/02* (2013.01); *A24D 1/14* (2013.01); *A24F 7/04* (2013.01); *F23Q 3/006* (2013.01)

(58) Field of Classification Search

CPC .. A24F 47/008; A24F 3/00; A24F 1/00; A24F 2700/00; A24F 2700/04; A24D 1/14; F23Q 3/006

See application file for complete search history.

(56) References Cited

U.S. PATENT DOCUMENTS 380,590 A * 4/1888 Peabody ..... A24D 1/14 131/348
1,849,795 A * 3/1932 Fenton ..... F23Q 7/00 131/185

(Continued)

OTHER PUBLICATIONS

SoloPipe, https://www.solopipe.com/, retrieved Jul. 9, 2018, 3 pages.

*Primary Examiner* — Michael H. Wilson
*Assistant Examiner* — Yana B Krinker
(74) *Attorney, Agent, or Firm* — Knobbe, Martens, Olson & Bear, LLP

(57) ABSTRACT

The disclosure herein provides methods, systems, and devices for electronic smoking. The embodiments disclosed herein can be utilized to ignite combustible substances in all conditions and do not require supplementary igniters or tools. The embodiments disclosed herein provide an all-in-one smoking experience. Further, in some embodiments described herein comprise a cartridge system for easy insertion, removal, and/or replacement of loose-leaf products in a pod or cartridge for smoking. Some embodiments herein relate to all-in-one, integrated smoking systems or devices comprising compartments for holding and lighting combustible substances, a combustion device such as a lighter or high voltage electric combustion system, insulating components, and one or more electric batteries or other power devices.

20 Claims, 65 Drawing Sheets

(56) References Cited

U.S. PATENT DOCUMENTS

| | | | | |
|---|---|---|---|---|
| 2,104,266 | A * | 1/1938 | McCormick | A24F 47/008 131/175 |
| 2,830,597 | A | 4/1958 | Kummli | |
| 4,141,369 | A | 2/1979 | Burruss | |
| 4,171,000 | A | 10/1979 | Uhle | |
| 4,303,083 | A * | 12/1981 | Burruss, Jr. | A61M 15/06 131/194 |
| 4,474,191 | A | 10/1984 | Steiner | |
| 4,922,901 | A | 5/1990 | Brooks et al. | |
| 4,945,931 | A | 8/1990 | Gori | |
| 4,947,874 | A | 8/1990 | Brooks et al. | |
| 4,947,875 | A | 8/1990 | Brooks et al. | |
| 4,966,171 | A | 10/1990 | Serrano et al. | |
| 4,991,606 | A | 2/1991 | Serrano et al. | |
| 5,093,894 | A | 3/1992 | Deevi et al. | |
| 5,224,498 | A | 7/1993 | Deevi et al. | |
| 5,249,586 | A | 10/1993 | Morgan et al. | |
| 5,269,327 | A | 12/1993 | Counts et al. | |
| 5,345,951 | A | 9/1994 | Serrano et al. | |
| 5,388,594 | A | 2/1995 | Counts et al. | |
| 5,505,214 | A | 4/1996 | Collins et al. | |
| 5,649,554 | A | 7/1997 | Sprinkel et al. | |
| 5,666,978 | A | 9/1997 | Counts et al. | |
| 7,415,982 | B1 | 8/2008 | Sheridan | |
| 8,997,753 | B2 | 4/2015 | Li et al. | |
| 9,408,416 | B2 | 8/2016 | Monsees et al. | |
| 9,596,885 | B2 | 3/2017 | Liu | |
| 9,861,133 | B2 | 1/2018 | Li et al. | |
| 9,901,116 | B2 | 2/2018 | Liu | |
| 2003/0015197 | A1 | 1/2003 | Hale et al. | |
| 2003/0209240 | A1 | 11/2003 | Hale et al. | |
| 2006/0283449 | A1 | 12/2006 | Balch et al. | |
| 2009/0320863 | A1 | 12/2009 | Fernando et al. | |
| 2010/0313901 | A1 | 12/2010 | Fernando et al. | |
| 2014/0261493 | A1 | 9/2014 | Smith et al. | |

* cited by examiner

ELECTRONIC SMOKING SYSTEMS, DEVICES, AND METHODS

CROSS-REFERENCE TO RELATED APPLICATION(S)

The present application claims the benefit under 35 U.S.C. § 119(c) of U.S. Provisional Patent Application No. 62/530,725, filed Jul. 10, 2017, which is incorporated herein by reference in its entirety under 37 C.F.R. § 1.57. Any and all applications for which a foreign or domestic priority claim is identified in the Application Data Sheet as filed with the present application are hereby incorporated by reference under 37 C.F.R. § 1.57.

BACKGROUND

Field

The present application relates to electronic smoking systems, devices, and methods.

Description

With the development of smoking technology, "vaping" and electronic vape devices have become widely popular. However, a majority of people who vape and smoke prefer smoking over vaping. An electronic vape device generally functions by heating a liquid to generate an aerosol, commonly called a "vapor" that the user inhales. However, smoking requires actual burning of a substance to generate smoke, as opposed to vape, which can be inhaled and absorbed into the bloodstream of a user. Smoking, unlike vaping, generally requires separate components for burning or combusting a substance to be smoked, such as a lighter. This may be inconvenient to some smokers as a combustible substance, a smoking device such as a pipe, and a separate lighter or combusting component are needed. Thus, novel systems, device, and methods for smoking are needed.

SUMMARY

Various embodiments described herein relate to smoking systems, devices, and methods, and in particular, to electronic smoking systems, devices, and methods. With the development of technology, vaping and electronic vape devices have become widely popular among current or previous smokers, as vaping can address some inconveniences associated with traditional smoking. For example, smoking can generally require physically lighting a smoke consumption device or product, which can be a problem if one does not have a separate lighter or matches on hand. Also, it can be difficult to light a cigarette, cigar, or the like in a windy or wet environment. While vaping may address one or more such concerns, a majority of people who vape and smoke still prefer smoking over vaping, due to the experience, taste, or the like. Accordingly, it can be advantageous to provide a system for smoking that address such shortcomings of traditional smoking while still providing the same or similar feel and taste of smoking that vaping cannot provide. However, the requirement for combustion components and the existence of a combusting substance makes designing an all-in-one smoking device more difficult than vape devices, which may use simple, small heating elements to vaporize the liquid therein. The various embodiments disclosed herein resolve these difficulties by providing for all-in-one electronic smoking systems, devices, and methods.

As such, various embodiments described herein provide electronic smoking systems, devices, and methods that resolve such shortcomings of traditional smoking while providing the experience of smoking. More specifically, certain embodiments described herein can allow a user to smoke without requiring a separate lighter or other lighting, igniting, or combusting systems, methods, and devices. In addition, some embodiments disclosed herein can allow a user to smoke regardless of wind, rain, or other weather conditions. Further, in some embodiments described herein allow a user to easily and conveniently insert, remove, and/or replace loose-leaf smoke products or combustible substances in removable pods or cartridges.

For purposes of this summary, certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

All of these embodiments are intended to be within the scope of the invention herein disclosed. These and other embodiments will become readily apparent to those skilled in the art from the following detailed description having reference to the attached figures, the invention not being limited to any particular disclosed embodiment(s).

In some embodiments, an electronic smoking system for burning and smoking a combustible substance comprises: a removable combustible substance pod configured to contain the combustible substance, wherein the removable combustible substance pod is capable of being removed from and reinserted into the electronic smoking system, the combustible substance pod comprising: a pod body comprising at least one opening for placement of at least one electrode at least partially into the pod body through the one or more openings; and one or more end caps; an electronic combustion device configured to ignite the combustible substance, the electronic combustion device comprising at least one electrode, wherein the at least one electrode is configured to be placed within the combustible substance pod and configured to ignite the combustible substance contained within the combustible substance pod; a battery; an insulation wall located between the battery and the removable combustible substance pod, wherein the insulation wall is configured to control or prevent heat flow from the combustible substance pod to the battery; and a casing comprising a plurality of internal compartments for containing the combustible substance pod, the electronic combustion device, and the battery.

In some embodiments, the combustible substance pod further comprises an electrode housing body configured to house the at least one electrode. In some embodiments, the combustible substance pod further comprises a transparent housing configured to be inserted into the pod body. In some embodiments, the pod body comprises one or more apertures configured to allow a user to view an internal volume of the pod body. In some embodiments, the combustible substance is a loose-leaf product. In some embodiments, the combustible substance pod comprises fire-resistant materials. In some embodiments, the combustible substance pod comprises stainless steel, glass, or durable plastic. In some embodiments, the pod body is transparent. In some embodiments, the one or more end caps comprise one or more air holes. In some embodiments, the one or more air holes are large enough to allow air and smoke to enter and exit the combustible substance pod. In some embodiments, the one or more air holes are small enough to prevent dislocation of solid loose-leaf products, combustible substances, or ash of a particular size.

In some embodiments, the electronic smoking system further comprises a filter. In some embodiments, the electronic smoking system further comprises an ignition button configured to close an electronic circuit upon compression, wherein closing the electronic circuit activates the electronic combustion device. In some embodiments, the electronic combustion device is configured to ignite the combustible substance substantially instantaneously upon compression of the ignition button. In some embodiments, the electronic smoking system further comprises a charging port configured to charge the battery when connected to an external power source. In some embodiments, the electronic combustion device comprises at least two electrodes configured to electrically discharge to ignite the combustible substance. In some embodiments, the casing further comprises a top lid, the top lid comprising a mouthpiece for drawing smoke from the casing, wherein the smoke is generated from ignition of the combustible material. In some embodiments, the casing further comprises a bottom lid, the bottom lid comprising one or more air inlet holes.

In some embodiments, a combustible substance pod device for insertion into an electronic smoking system for burning and smoking a combustible substance comprises: a top end cap comprising a plurality of outlet air holes configured to allow air and smoke to exit the combustible substance pod; a bottom end cap comprising a plurality of inlet air holes configured to allow air to enter the combustible substance pod; and a pod body comprising: an internal volume configured to contain a combustible substance; one or more electrode holes configured to house electrodes connected to an electronic combustion device; wherein the top end cap and bottom end cap are coupled to the pod body to close the internal volume; wherein the outlet air holes and inlet air holes are configured to prevent the combustible substance from dislocating from the internal volume of the pod body.

In some embodiments, the pod body further comprises one or more viewing apertures, configured to allow a user to view a combustible substance within the combustible substance pod device. In some embodiments, the top end cap and the bottom end cap are removable.

BRIEF DESCRIPTION OF THE DRAWINGS

A better understanding of the devices and methods described herein will be appreciated upon reference to the following description in conjunction with the accompanying drawings, wherein.

DETAILED DESCRIPTION

Figure 1:
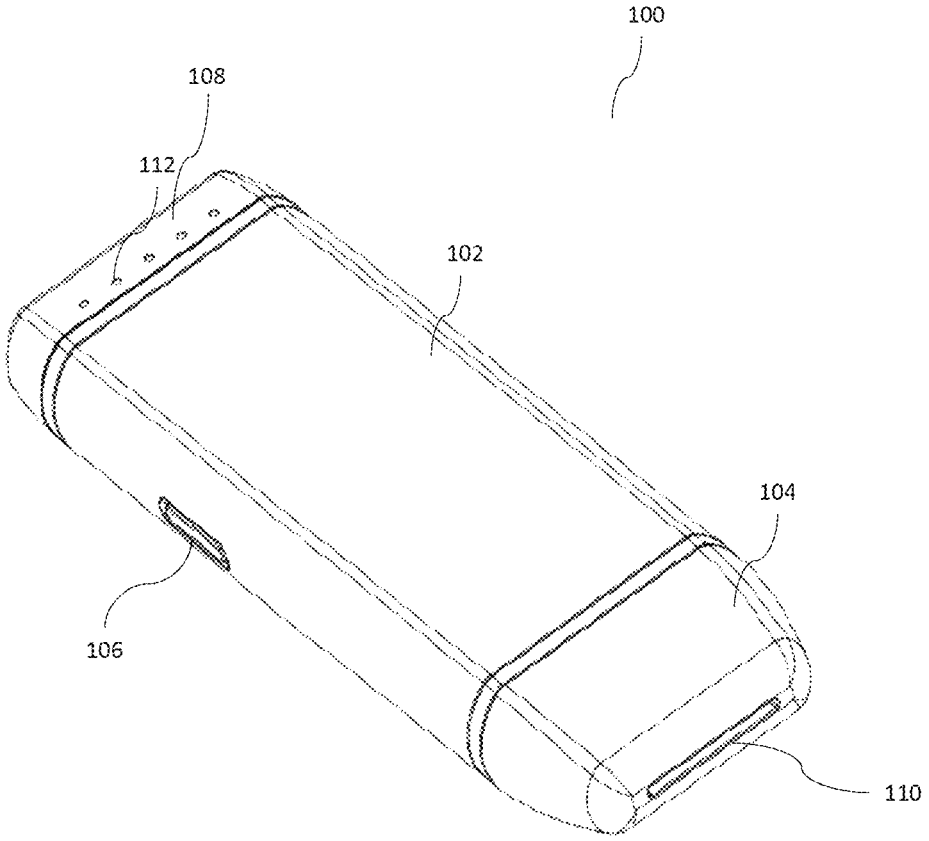
FIG. 1 illustrates a front perspective view of an example embodiment of a smoking device or system.

Although several embodiments, examples, and illustrations are disclosed below, it will be understood by those of ordinary skill in the art that the inventions described herein extend beyond the specifically disclosed embodiments, examples, and illustrations and includes other uses of the inventions and obvious modifications and equivalents thereof. Embodiments of the inventions are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Various embodiments described herein relate to novel smoking systems, devices, and methods, and in particular to electronic smoking systems, devices, and methods. With the development of technology, vaping and electronic vape devices have become popular in part due to its conveniences. However, a majority of people who vape and smoke still prefer smoking over vaping, due to the experience, taste, or the like. As such, various embodiments described herein relate to smoking systems, devices, and methods that provide the same or similar feel and taste of smoking but address certain inconveniences generally associated with smoking. For example, in some embodiments described herein comprise a lighter within the device or system such that a user can smoke without requiring a separate lighter or other lighting means. In addition, some embodiments described herein allow easy ignition regardless of the wind, rain, or other external conditions by use of a lighter incorporated within the device or system. In some embodiments, the smoking system or device does not comprise an open flame or any flame, spark, or ignition on the exterior and/or interior of the system or device. Further, in some embodiments described herein comprise a cartridge system for easy insertion, removal, and/or replacement of loose-leaf products in a pod or cartridge for smoking. Some embodiments herein relate to all-in-one, integrated smoking systems or devices comprising compartments for holding and lighting combustible substances, a combustion device, such as a lighter or high voltage electric combustion system, insulating components, and/or one or more electric batteries or other power devices. In some embodiments, the smoking system or device may also comprise overcharge or overheating protection devices, systems, and/or methods to protect the internal components and the user from harm.

In some embodiments herein, an all-in-one-smoking system or device is provided comprising an ignition button that, when compressed, leads to or causes ignition of a combustible substance, generating smoke. In some embodiments, the ignition button is configured to close an electrical switch and/or circuit, which activates a combustion system or device, such as a lighter or high voltage electric combustion system, which commences burning of a combustible substance. In some embodiments, the smoking system or device is configured to initiate a combustion reaction, such that a combustible material undergoes an exothermic redox chemical reaction. In some embodiments, the combustion reaction may become self-sustaining after initial ignition of the combustible material. In some embodiments, the smoking system or device does not include a convective heating device. In some embodiments, the heated material in the device is burned, combusted, ignited, or otherwise set on fire. In some embodiments, the combustible material does not solely undergo a phase change upon heating, but also undergoes a chemical reaction as it is burned within the smoking system or device. In some embodiments, combustion of the combustible substance or loose-leaf product releases components of the product in gaseous form to be inhaled by a user. In some embodiments, the smoking device or system does not include a conventional lighter, such as a butane lighter, and does not produce an open flame. In some embodiments, since the smoking device or system does not produce an open flame or include a conventional exterior or interior lighter, it can safely and effectively be used in any weather conditions, such as high winds, rain, snow, and hail. In some embodiments, the device does not require lighter fluid or any other combustible fuel to function. In some embodiments, combustion of a combustible substance or loose-leaf product may be initiated by a high-voltage electronic arc device, wherein the high-voltage electronic arc device may comprise one or more electrodes that electrically discharge to produce a spark which may ignite the combustible substance. In some embodiments, the all-in-one smoking systems and devices comprise a combustible substance cartridge, compartment, slot, container, holder, receptacle, pod, or the like that is configured to hold or store a combustible substance, allow air input, and/or allow output of smoke from the device to the user. In some embodiments, some or all of the side walls of the combustible substance pod, for example, the anterior, posterior, lateral side walls may be transparent, entirely or partially, to allow visibility through one or more portions of the side wall of the substance and/or smoke by a user. In some embodiments, the combustible substance pod may be freely removable, loadable, and/or exchangeable into and out of the all-in-one-smoking system or device. For example, the combustible substance pod may be removed from the all-in-one-smoking system or device to load a combustible substance, and reloaded into the device for smoking. In some embodiments, the combustible substance pod may comprise one or two or more electrodes that may discharge to ignite a combustible substance within the pod. The one or more electrodes can have various configurations and placements on or within the pod. For example, the electrodes may be located on the corners, bottom, middle, and/or top of the pod or anywhere in between these locations. Furthermore, for a cylindrical pod, the electrodes may be located along the circumference of the pod body or on either the top or bottom end caps of the pod. In some embodiments, the components of the combustible substance pod comprise fire-resistant, non-leeching materials. In some embodiments, the components of the combustible substance pod are made from glass, steel, durable, high-temperature plastic, thermoplastics, for example, polyamide-imide, Acrylonitrile Butadiene Styrene, Acrylonitrile Styrene Acrylate, Cellulose Acetate, Ethylene-based plastics, Polymer-based plastics, or other plastics having a continuous service temperature of about 60° C., 70° C., 80° C., 90° C., 100° C., 110° C., 120° C., 130° C., 140° C., or 150° C., or more or other fire-resistant material. In some embodiments, the pod comprises entirely of or partially of a wire mesh. In some embodiments, the smoking system or device can include a non-removable combustible substance chamber configured to contain a combustible substance or loose-leaf product. In some embodiments, the device or system may not comprise a removable combustible substance pod.

In some embodiments, the combustible substance pod or other compartment for holding the combustible substance of the smoking system comprises 2 electrodes. In some embodiments, the combustible substance pod comprises between 2 and 20 electrodes. In some embodiments, the combustible substance pod or other compartment for holding the combustible substance of the smoking system comprises 1, 2, 3, 4, 5, 6, 7, 8, 9, 10, 11, 12, 13, 14, 15, 16, 17, 18, 19, 20, or more electrode(s). In some embodiments, the combustible substance pod or other compartment for holding the combustible substance comprises a number of electrodes within a range defined by two of the aforementioned values.

In some embodiments, the smoking system or device may comprise an electronic ignition device. In some embodiments, the electronic ignition device comprises an arc lighter. In some embodiments, the electronic ignition device produces an electric arc or discharge by ionizing air. In some embodiments, the electronic ignition device discharges when high voltage is pulsed across the electrodes to ignite or strike the arc. In some embodiments, after an initial arc or discharge is produced by an initial voltage, an ongoing discharge can be maintained with a lower voltage than the initial voltage. In some embodiments, the temperature of the electric arc or discharge produced by the electronic ignition device can be at least high enough to combust a combustible substance or loose-leaf product. In some embodiments, the temperature of the electric arc or discharge may be at least 600 degrees Celsius.

In some embodiments, the electronic ignition device does not require fuel to produce an electronic arc or discharge. In some embodiments, the electric arc or discharge produced by the electronic ignition device. In some embodiments, the electronic ignition device produce an electronic arc or discharge regardless of the orientation of the smoking system or device and regardless of external conditions such as inclement weather. In some embodiments, the electronic ignition device is powered by, for example, a rechargeable lithium-ion battery. In some embodiments, the electronic ignition device comprises one or more conducting ceramic or metal electrodes. In some embodiments, the one or more electrodes are housed within the combustible substances pod and protrude from the exterior of the pod. In some embodiments, the protruding electrodes may serve as an alignment mechanism when the combustible substance pod is inserted into the smoking system or device.

In some embodiments of the smoking devices or systems described herein can be thermally optimized by allowing smoke to flow around the outside to cool, thereby providing a more comfortable draw. For example, the pod can be configured to allow smoke to flow from the center of the pod to the outer portion of the pod, along the side walls of the pod in order to allow the smoke to cool before a user intakes the smoke. In some embodiments, the pod is configured to allow the smoke to flow from inside the pod to an area outside of the pod, for example, a secondary chamber, but still within the smoking device to allow the smoke to cool before a user intakes the smoke. In addition, some embodiments can comprise one or more removable parts, such as a pod or cartridge for holding loose-leaf products, ignition bowl, smoke pipe, vent covers, or the like. As such, any one or more of such removable parts can be removed for easy cleaning and/or replacement. Moreover, in some embodiments comprise an igniter or auto-igniter for igniting a loose-leaf product for smoking. The auto-igniter can be built into the smoking device or system or in some embodiments, be removably attached to the device or system. The auto-igniter can be rechargeable, for example, through a built-in USB charging port that charges a battery, or through a wireless power charging system wherein the device comprises a charging coil, or through other power charging systems within the device or system. The battery or other power source can hold sufficient power to last about a day, week, or month or over a month of average smoking use in some embodiments. In some embodiments, the device or system may utilize a lithium-ion battery. In some embodiments, the smoking device or system can comprise one or more sensors, such as heat sensors and/or temperature sensors. The one or more sensors can be configured to act as safety mechanisms to detect the temperature of the device or system to prevent overheating and/or injury to the user. In some embodiments, the temperature and/or heat sensors can be located on or in proximity to the battery or on or in proximity to the combustible substance pod or compartment. For example, when the temperature of the system or device is at or above a predetermined threshold level or a user defined threshold level, the system or device can be configured to automatically disable the igniter and/or extinguish any burning particles inside the device or system. In some embodiments, the system or device may be configured to cut off air flow within the device or system by, for example, a mechanical or electro-mechanical cover device that may block any air inlets or outlets in the smoking device or system. In some embodiments, restricting air flow into and/or out of the device or system may extinguish any ignited product within. In some embodiments, the device or system may be able to extinguish any combustible substance on-demand, such that the device or system can conserve combustible substance for future use. In some embodiments, the smoking system or device can facilitate efficient use of a combustible substance and reduce waste by providing smoke on-demand and a streamlined extinguishment system. In some embodiments, the smoking system or device may comprise one or more temperature and/or heat sensors, which may be configured to detect heat levels within the device or system. In some embodiments, the one or more temperature and/or heat sensors may be connected to a heat controller, which may automatically react to heat and temperature readings above a predetermined threshold to prevent the smoking system or device from overheating and/or posing a danger to a user. In some embodiments, the heat controller may automatically initiate an extinguishing protocol, which may prevent any ignition of the ignition device, restrict air flow into and out of the system or device, and take other appropriate cooling measures.

Various embodiments of the smoking devices or systems can comprise a housing structure with a releasable or sliding lid portion. The housing structure and/or a portion thereof, such as the outer casing, can be made of stainless steel. When the lid portion is opened, a pod or cartridge configured to hold loose-leaf product can be placed into the housing structure. For example, within the housing structure, the device or system can comprise a designated holding portion for inserting a pod or cartridge. The pod or cartridge can be easily removed from the device or system for easy cleaning and/or replacement.

In some embodiments, a length of the smoking device or system along a longitudinal axis can be about 116.41 mm. In other embodiments, a length of the device or system along a longitudinal axis can be about 50 mm, about 60 mm, about 70 mm, about 80 mm, about 90 mm, about 100 mm, about 110 mm, about 120 mm, about 130 mm, about 140 mm, about 150 mm, about 160 mm, about 170 mm, about 180 mm, about 190 mm, about 200 mm, and/or within a range defined by two of the aforementioned values.

In some embodiments, a height of the smoking device or system along a short axis can be about 46.03 mm. In other embodiments, a height of the smoking device or system along a short axis can be about 20 mm, about 25 mm, about 30 mm, about 35 mm, about 40 mm, about 45 mm, about 50 mm, about 55 mm, about 60 mm, about 65 mm, about 70 mm, about 75 mm, about 80 mm, and/or within a range defined by two of the aforementioned values.

In some embodiments, a thickness of the smoking device or system can be about 20.16 mm. In other embodiments, a thickness of the device or system can be about 5 mm, about 10 mm, about 15 mm, about 16 mm, about 17 mm, about 18 mm, about 19 mm, about 20 mm, about 21 mm, about 22 mm, about 23 mm, about 24 mm, about 25 mm, about 30 mm, about 35 mm, and/or within a range defined by two of the aforementioned values.

In contrast to vape devices, some embodiments of the device or system can comprise an ignition device to actually ignite and/or smoke a loose-leaf product or other combustible substance rather than heating a liquid into vapor. In some embodiments, a combustible substance pod can be configured to provide a safe environment for igniting loose-leaf product within the system or device. The pod can be configured to create an electronic mesh to maximize and/or guarantee that any amount of loose-leaf product will get lit completely. In some embodiments, the device or system can provide instant ignition. For example, with one touch by a user, the ignition zone can instantly reach about or over 2,000 degrees Fahrenheit. Further, the device or system can be configured to employ electronic ignition, which can be safer and/or healthier compared to traditional lighters which may employ butane or other toxic materials as fuel. In some embodiments, the smoking system or device can provide a safe, continuous burning or smoking experience through an uninterrupted burn of loose-leaf product. For example, the combustible substance or loose-leaf product may continue burning within the system or device even after the ignition button is released and the electric ignition device has ceased its ignition function. In some embodiments, the smoking system or device may optionally comprise a fan or other air flow device that may facilitate air flow through the device and through the combustible substance pod. In some embodiments, the fan may comprise heat and/or temperature sensors to determine if a combustible substance or loose-leaf product is burning within the device, and a fan speed controller that may control the fan to provide adequate air flow to facilitate a continuous burn. In some embodiments, continuous air flow through the device may facilitate persistent burn of a combustible substance, such that a user can continue drawing smoke without re-ignition. In some embodiments, the smoking system or device may optionally comprise a paper or other flammable lining to be inserted into a combustible materials pod along with loose-leaf product, the paper or other flammable lining configured to facilitate a nonstop, ongoing and controlled burn of loose-leaf product. In some embodiments, a combustible substance or loose-leaf product may be pre-rolled in a paper or other flammable material before insertion into the smoking system or device. In some embodiments, the smoking system or device, and in particular, the combustible substance compartment or pod can be configured to provide a safe open-fire environment by providing containment, insulation, and fire-resistance.

In some embodiments, a combustible material or substance pod or cartridge may be configured to be used with various embodiments of the smoking devices and systems described herein. In some embodiments, the pod or cartridge can hold loose-leaf product for insertion into a device or system. In some embodiments, the pod or cartridge can comprise a main chamber for holding the loose-leaf product, a top end cap, and/or a bottom end cap. The top and/or bottom end caps can be removable. The combustible substance pod or cartridge can comprise a generally cylindrical and/or column shape but other shapes and configurations are possible without deviating from the spirit of the embodiments disclosed herein. An outer diameter of a pod or cartridge can be about 12.7 mm. In some embodiments, an outer diameter of a pod or cartridge can be about 6 mm, about 7 mm, about 8 mm, about 9 mm, about 10 mm, about 11 mm, about 12 mm, about 13 mm, about 14 mm, about 15 mm, about 16 mm, about 17 mm, and/or within a range defined by two of the aforementioned values. Further, a length of a pod or cartridge along a longitudinal axis can be about 34 mm. In some embodiments, a length of a pod or cartridge along a longitudinal axis can be about 30 mm, about 31 mm, about 32 mm, about 33 mm, about 34 mm, about 35 mm, about 36 mm, about 37 mm, about 38 mm, about 39 mm, about 40 mm, and/or within a range defined by two of the aforementioned values. An outer diameter of a pod or cartridge can be about 15.9 mm. Further, a length of a pod or cartridge along a longitudinal axis can be about 31 mm.

In some embodiments, the combustion substance pod end caps can comprise a plurality of openings or holes to allow smoke generated from burning the loose-leaf product or combustion substance to flow out of the chamber such that a user can inhale the smoke. The plurality of openings or holes of an end cap can comprise a number of different patterns and sizes to optimize smoke flow or prevent solid residue from reaching the user. In some embodiments, the end caps or other components may include a filter for preventing ash or other solid residues from transmitting through the plurality of openings to the user, for example as the user inhales smoke from the system or device. In some embodiments, the plurality of openings in either or both of the caps can be configured to open and close or substantially close by applying a voltage to the end caps, or in some embodiments, the system comprises a mechanical cover configured to open and close or substantially close the plurality of openings in either or both of the caps. In some embodiments, the plurality of openings are positioned on the side walls of the pod instead of or in addition to a plurality of openings on the caps.

Some embodiments herein relate to an ignition process for the smoking devices and systems described herein. In some embodiments, the device or system can be configured to force or generate an electric arc, for example from a small custom designed fly-back transformer. More specifically, in some embodiments, power can be inputted, which may charge a primary winding and a feedback winding, which may oscillate a transistor or metal-oxide-semiconductor field-effect transistor (MOSFET), allowing for a high frequency pulse to be sent through to a secondary coil which can discharge. In some embodiments, the circuit can further comprise a USB charging circuit and/or one or more LED or other signals for showing a charge status. Further, the circuit can also comprise a 555 timer for controlling the duration of the arc to prevent overheating of the transformer and/or the transistor. In addition, the circuit can further comprise an under/over voltage protection for the transformer. In some embodiments, the device or system can be configured to prevent internal arcing, for example by wrapping Teflon insulation every, for example, 100 windings to the transformer. Further, the device or system can be configured to prevent external arcs, for example by encasing the transformer in epoxy. In some embodiments, the smoking systems and devices herein are configured to provide substantially instant ignition of a combustible substance.

Figure 2:
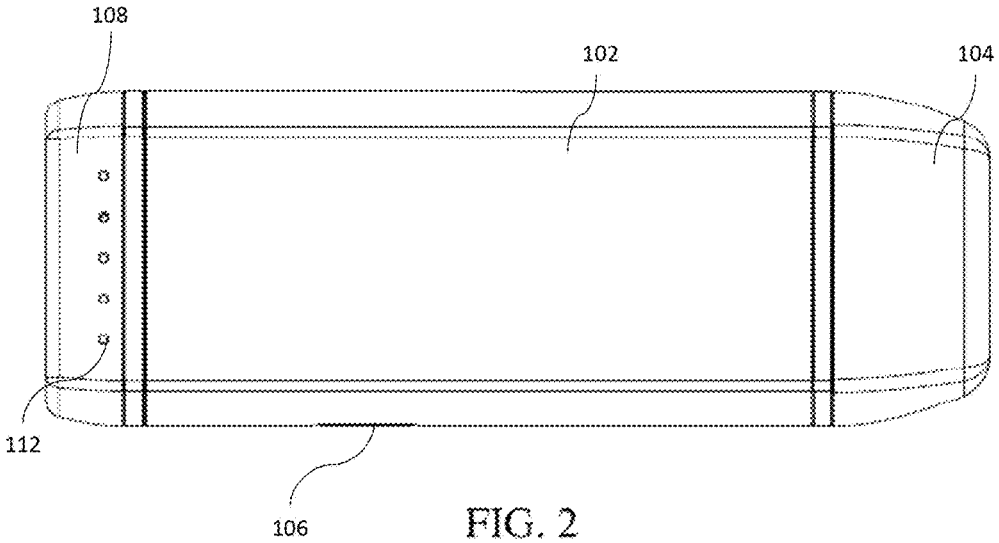
FIG. 2 illustrates a front view of the example embodiment of a smoking device or system of FIG. 1.

FIG. 1 illustrates a front perspective view of an example embodiment of a smoking device or system in accordance with various embodiments herein. The smoking device or system 100 comprises a body 102, a top lid 104, an ignition button 106, and a bottom lid 108. The body 102 of the smoking system or device may comprise the internal components of the device, for example, a combustion device or lighter, a combustible substance pod, one or more batteries, insulating materials, and electronic circuitry. FIG. 2 illustrates a front view of the example embodiment of a smoking device or system of FIG. 1.

Figure 3:
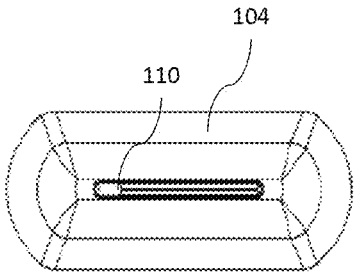
FIG. 3 illustrates a top view of the example embodiment of a smoking device or system of FIG. 1.

FIG. 3 illustrates a top view of the example embodiment of a smoking device or system of FIG. 1. The top lid 104 may comprise one or more openings or smoke outlets 110 from which smoke can be drawn from the device or system by the user, for example by inhaling. The one or more openings or smoke outlets 110 are not limited to the shape, placement, and configuration shown in the figures. The shape, placement, and configuration one or more openings or smoke outlets 110 may be altered to allow improved air flow into the device.

In some embodiments, the top lid 104 may be configured to slide laterally to reveal a charging port 114, to which a battery charger can be connected to recharge the device or system.

Figure 4:
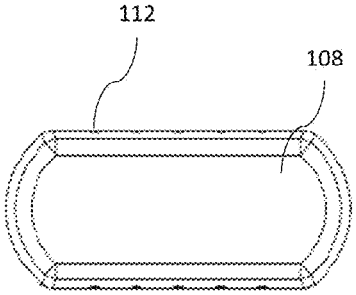
FIG. 4 illustrates a bottom view of the example embodiment of a smoking device or system of FIG. 1.

FIG. 4 illustrates a bottom view of the example embodiment of a smoking device or system of FIG. 1. The bottom lid 108 may comprise one or more air inlet holes 112, which may allow air to enter the device as smoke is drawn from the device by a user and/or to provide oxygen for combustion of the loose-leaf or other combustible product within the combustible substance holder. The air inlet holes 112 are not limited to the shape, placement, and configuration shown in the figures. The shape, placement, and configuration of the air inlet holes 112 may be altered to allow improved air flow into the device.

Figure 5:
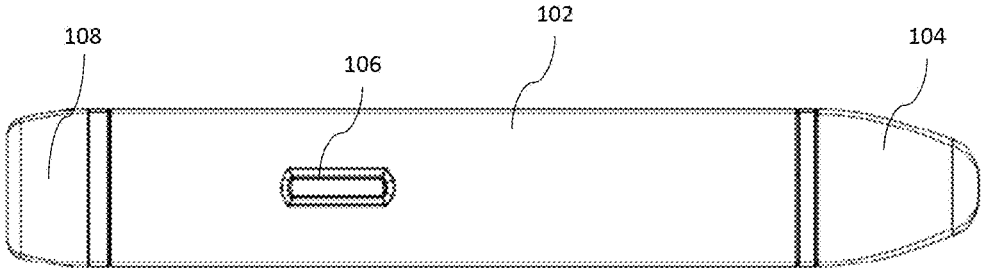
FIG. 5 illustrates a side view of the example embodiment of a smoking device or system of FIG. 1.
Figure 6:
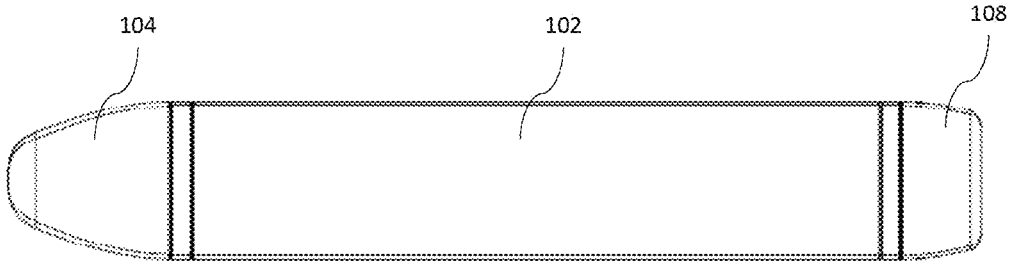
FIG. 6 illustrates another side view of the example embodiment of a smoking device or system of FIG. 1.

FIGS. 5 and 6 illustrate side views of the example embodiment of a smoking device or system of FIG. 1. In some embodiments, an ignition button 106 may be placed on the side of the device or system. In other embodiments, an ignition button 106 may be placed at other locations on the device or system, for example, the front or the back of the device. In some embodiments, the ignition button 106 can be located on the same side of the device or system as a battery. In some embodiments, compression of the ignition button 106 by a user closes an internal circuit in the device or system, causing the internal electrodes to discharge and ignite a combustible substance within a combustible substance pod, creating smoke. In some embodiments, smoke can be drawn from the system of device by a user from the one or more openings or smoke outlets 110 of the top lid 104.

Figure 7:
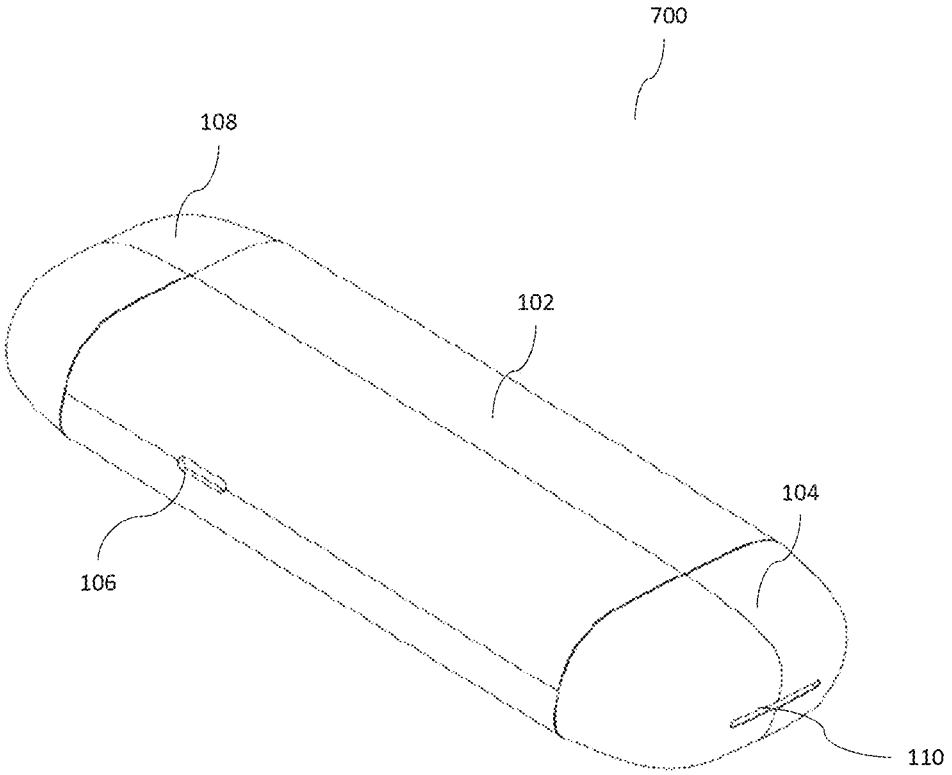
FIG. 7 illustrates a front perspective view another example embodiment of a smoking device or system.
Figure 8:
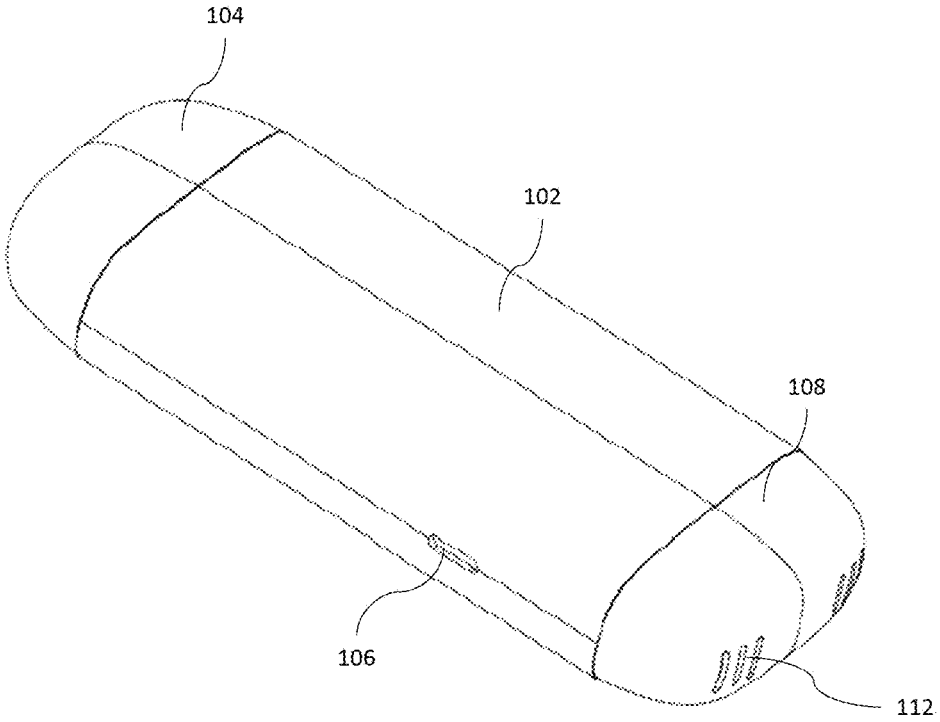
FIG. 8 illustrates a rear perspective view of the example embodiment of a smoking device or system shown in FIG. 7.

FIG. 7 illustrates a front perspective another example embodiment of a smoking device or system. The smoking system or device 700 includes some or all of the features of the example smoking system or device 100 of FIG. 1. For example, the example smoking device or system 700 includes a body 102, a top lid 104, one or more ignition buttons 106, a bottom lid 108, one or more openings or smoke outlets 110, and one or more air inlet holes 112. FIG. 8 illustrates a rear perspective view of the example embodiment of a smoking device or system shown in FIG. 7. As shown by FIG. 1 and FIG. 8, the number, configuration, placement, and shape of the air inlet holes 112 of all the devices or systems herein may be varied.

Figure 9:
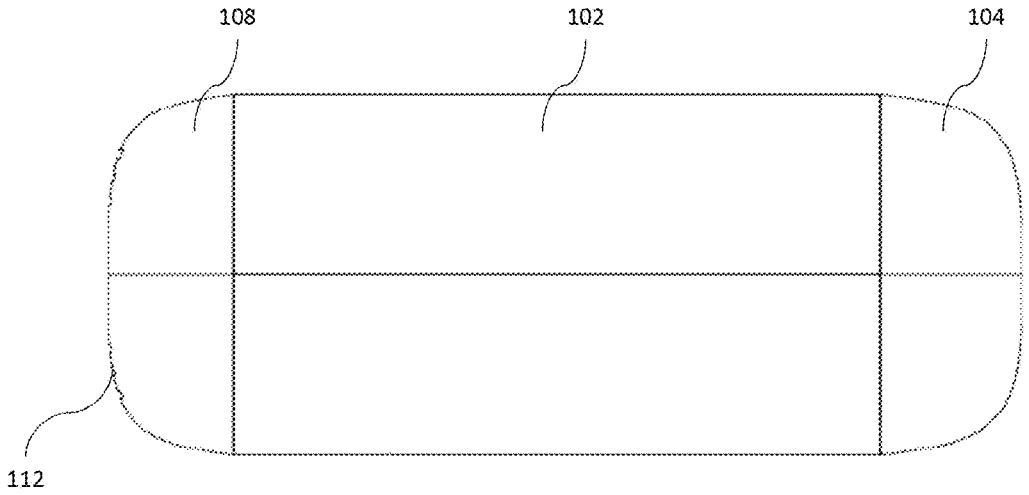
FIG. 9 illustrates a front view of the example embodiment of a smoking device or system of FIG. 7.
Figure 10:
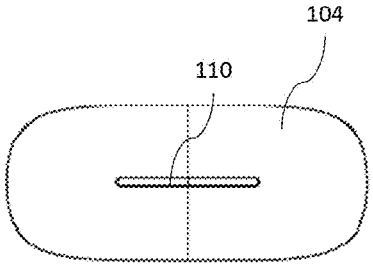
FIG. 10 illustrates a top view of the example embodiment of a smoking device or system of FIG. 7.
Figure 11:
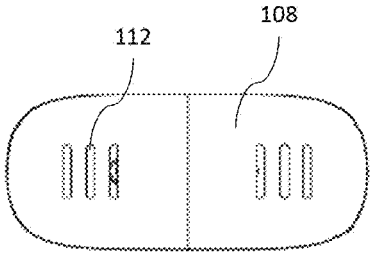
FIG. 11 illustrates a bottom view of the example embodiment of a smoking device or system of FIG. 7.
Figure 12:
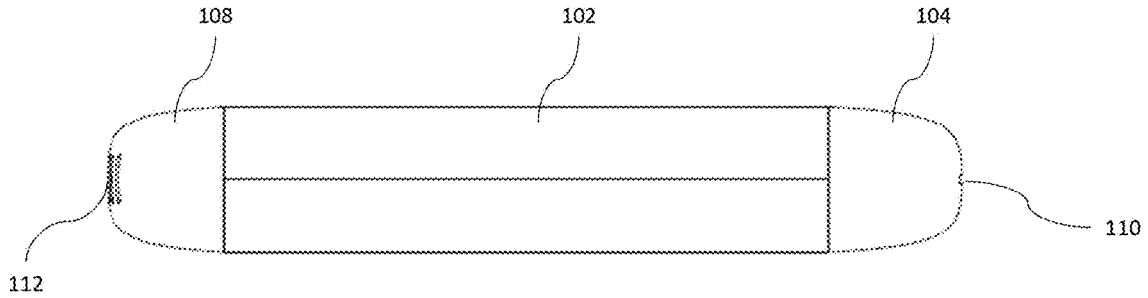
FIG. 12 illustrates a side view of the example embodiment of a smoking device or system of FIG. 7.
Figure 13:
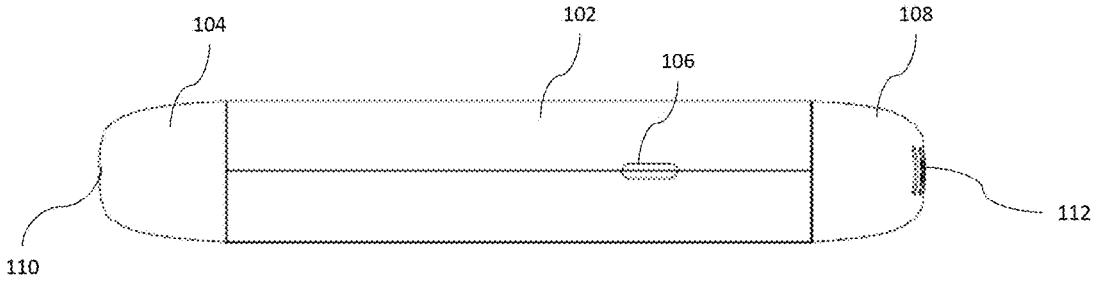
FIG. 13 illustrates another side view of the example embodiment of a smoking device or system of FIG. 7.

FIG. 9 illustrates a front view of the example embodiment of a smoking device or system of FIG. 7. In some embodiments, the smoking device or system 700 may be substantially symmetrical, excluding the air inlet holes 112, the one or more ignition buttons 106, and the one or more openings or smoke outlets 110. FIG. 10 illustrates a top view of the example embodiment of a smoking device or system of FIG. 7. FIG. 11 illustrates a bottom view of the example embodiment of a smoking device or system of FIG. 7. FIGS. 12 and 13 illustrate side views of the example embodiment of a smoking device or system of FIG. 7. The ignition button 106, shown in FIG. 13, may vary in placement, shape, number, and size from the specific embodiment shown. For example, the ignition button 106 could be located on the other side of the smoking system, the top lid, the bottom lid, or otherwise.

Figure 14:
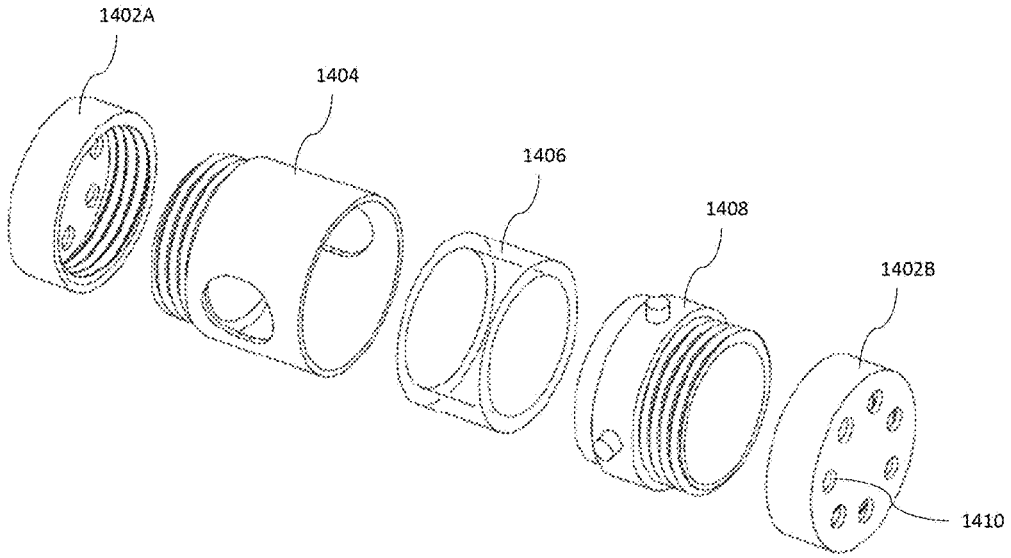
FIG. 14 illustrates an exploded view of an example combustible substance pod in accordance with various embodiments herein.

FIG. 14 illustrates an exploded view of an example combustible substance pod 1400 in accordance with various embodiments herein. The example combustible substance pod 1400 comprises a top end cap 1402A, a pod body 1404, a transparent housing 1406, an electrode housing body 1408, and a bottom end cap 1402B. In some embodiments, all components of the combustible substance pod 1400 can be made from fire and heat-resistant materials, such that they can withstand electronic ignition of a combustible substance within the pod 1400, without warping, burning, igniting, degrading, leeching, or otherwise reacting to the heat or ignition. In some embodiments, the transparent housing 1406 can be inserted into the pod body 1404 and/or electrode housing body 1408. In some embodiments, especially those embodiments in which the pod body 1404 comprises an aperture, the transparent housing serves as a barrier, containing the loose-leaf products or combustible substances within the pod 1400. In some embodiments, the transparent housing 1406 is see-through, such that a user can observe the combustible substances and/or smoke within the pod 1400. In some embodiments, an opaque or translucent housing may be utilized instead of the transparent housing 1406. In some embodiments, the transparent housing may be glass.

Figure 15:
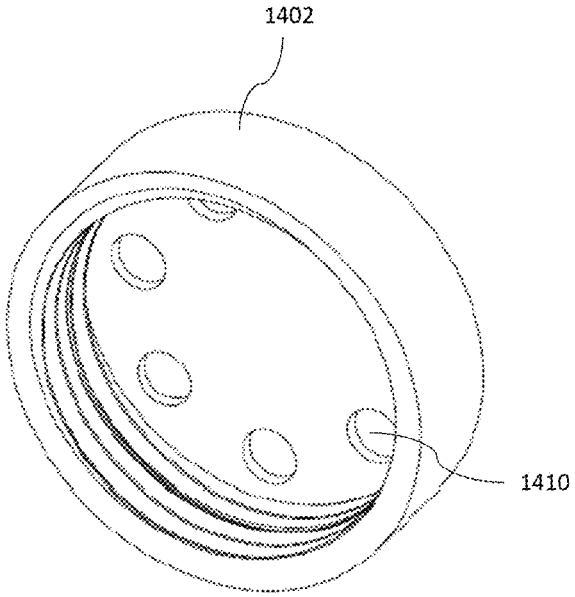
FIG. 15 illustrates a bottom perspective view of an example end cap for a combustible substance pod in accordance with various embodiments herein.
Figure 16:
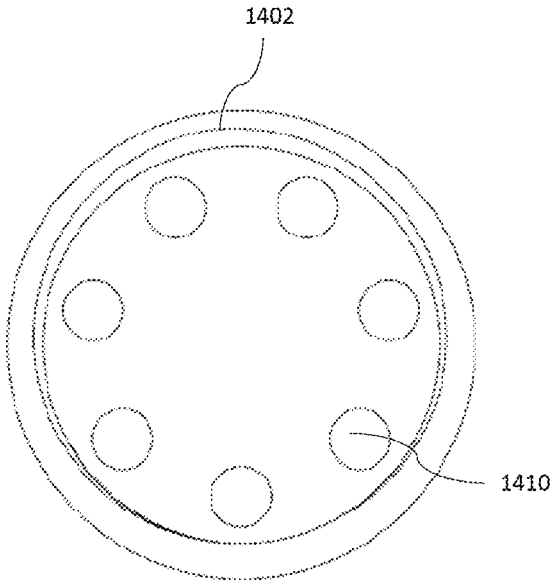
FIG. 16 illustrates a bottom view of the example end cap for a combustible substance pod shown in FIG. 15.
Figure 17:
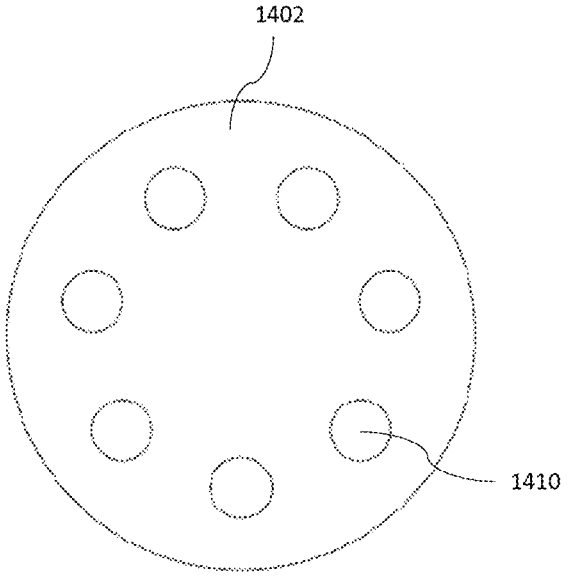
FIG. 17 illustrates a top view of the example end cap for a combustible substance pod shown in FIG. 15.
Figure 18:
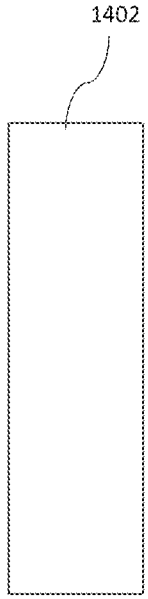
FIG. 18 illustrates a side view of the example end cap for a combustible substance pod shown in FIG. 15.

FIGS. 15-18 illustrate various view of an example top or bottom end cap 1402 for a combustible substance pod in accordance with various embodiments herein. FIG. 15 illustrates a bottom perspective view of example end cap. FIG. 16 illustrates a bottom view of the example end cap for a combustible substance pod shown in FIG. 15. FIG. 17 illustrates a top view of the example end cap for a combustible substance pod shown in FIG. 15. FIG. 18 illustrates a side view of the example end cap for a combustible substance pod shown in FIG. 15.

The end cap 1402 may be utilized with various other components to form a combustible substance pod, for example, the example combustible pod 1400 of FIG. 14. The end cap 1402 may connect to a pod body 1404, electrode housing body 1408, an insulating body, a transparent housing 1408, or other components of a combustible substance pod to contain loose-leaf products or combustible substances therein. The end cap 1402 may comprise one or more air holes 1410, which can be large enough to allow air and smoke to enter and exit the combustible substance pod, but may be small enough to prevent dislocation of solid loose-leaf products or combustible substances, or ash, for example larger than a particular size. The size, orientation, placement, and number of the one or more air holes 1410 may differ from the example embodiment shown. In some embodiments, the end cap 1402 comprises 7 air holes 1410.

In some embodiments, the internal circumference of the end cap 1402 can be threaded, such that it can be fastened to other components by screwing or turning. In other embodiments, other common or specialized means for fastening the end cap 1402 to other components of a combustible substance pod can be utilized. For example, the end cap 1402 may simply be snapped unto the pod body or other components.

In some embodiments, a combustible substance pod, such as the example combustible substance pod 1400 of FIG. 14, can comprise a top end cap 1402A and a bottom end cap 1402B. In those embodiments, the bottom end cap 1402B allows air to flow from the bottom of a smoking device or system through the bottom end cap into the combustible substance pod. The top end cap 1402A may allow smoke and air to be drawn, by a user, out of the combustible substance pod after ignition of a combustible substance. The top and bottom end cap may be substantially identical, or they may differ in size, shape, or orientation. In some embodiments, both end caps may be removable, such that the pod body 1404 and other components of a combustible materials pod can be cleaned.

Figure 19:
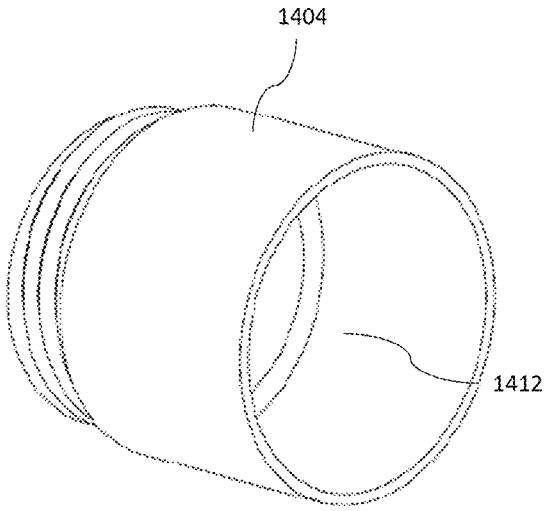
FIG. 19 illustrates a bottom perspective view of an example combustible substance pod body in accordance with various embodiments herein.
Figure 20:
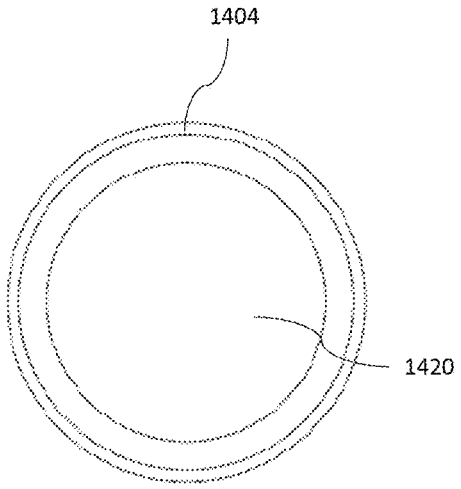
FIG. 20 illustrates a bottom view of the example combustible substance pod body shown in FIG. 19.
Figure 21:
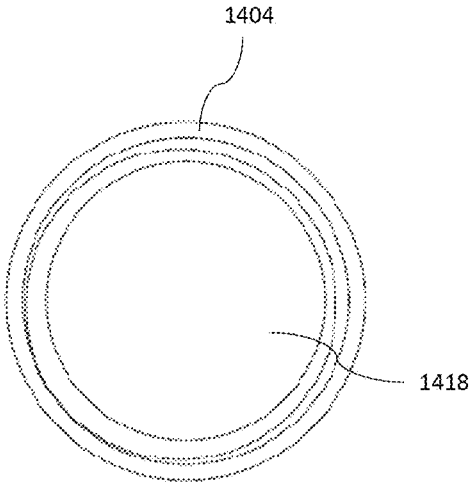
FIG. 21 illustrates a top view of the example combustible substance pod body shown in FIG. 19.
Figure 22:
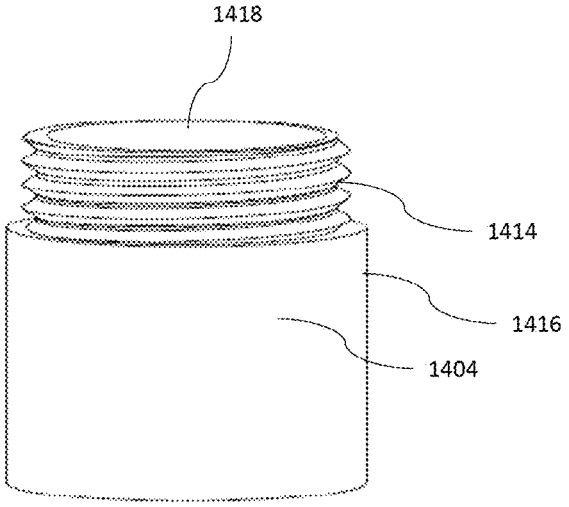
FIG. 22 illustrates a side view of the example combustible substance pod body shown in FIG. 19.

FIGS. 19-22 illustrate various views of an example pod body 1404 for a combustible substance pod in accordance with various embodiments herein. FIG. 19 illustrates a bottom perspective view of the example combustible substance pod body 1404 in accordance with various embodiments herein. FIG. 20 illustrates a bottom view of the example combustible substance pod body shown in FIG. 19. FIG. 21 illustrates a top view of the example combustible substance pod body shown in FIG. 19. FIG. 22 illustrates a side view of the example combustible substance pod body shown in FIG. 19.

In some embodiments, the pod body 1404 comprises a cylindrical exterior shape and an internal volume 1412 for containing a combustible substance. In some embodiments, the pod body 1404 comprises a transparent material, such that a combustible substance therein can be viewed by a user. The pod body 1404 may comprise a narrow cylindrical portion 1414 and a wide cylindrical portion 1416. The narrow cylindrical portion 1414 may be externally threaded, such that it may be fastened or connected with other components of a combustible substance pod, for example, an internally threaded end cap. When combined with an end cap 1402, the circumference of the narrow cylindrical portion 1414 may be substantially the same as the wide cylindrical portion 1416 to form a substantially seamless cylindrical pod. In some embodiments, the wide cylindrical portion 1416 may be internally threaded, such that it may be connected to an externally threaded component of a combustible substance pod. In some embodiments, the pod body 1404 can be configured to contain a transparent housing, such as the transparent housing 1406 of FIG. 14. In some embodiments, the transparent housing 1406 may be inserted securely along the inner circumference of the pod body 1404. In some embodiments, the sides of the pod body 1404 comprise no apertures or holes. In some embodiments, the top of the pod body 1404 comprises a top opening 1418, allowing insertion of a combustible substance by a user for example, when an end cap 1402 is unfastened from the pod body 1404. In some embodiments, the bottom of the pod body 1404 comprises a bottom opening 1420, the bottom opening configured to couple with other components of a combustible substance pod, for example, an electrode housing body such as electrode housing body 1408 of FIG. 14. In some embodiments, when the pod body 1404 is coupled to an end cap and an electrode housing body, an expanded interior volume is formed to contain a combustible substance therein. In some embodiments, the components can be coupled together using, for example, an industrial adhesive.

Figure 23:
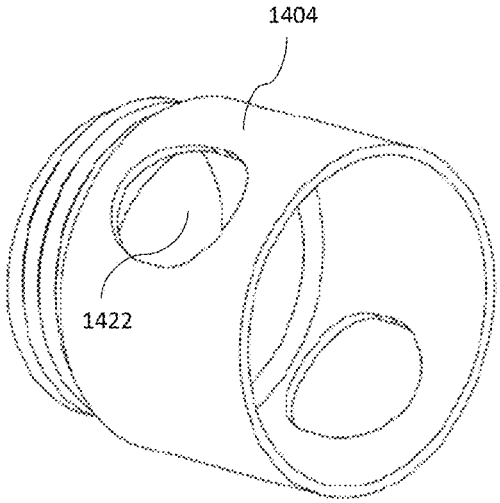
FIG. 23 illustrates a bottom perspective view of another example combustible substance pod body in accordance with various embodiments herein.
Figure 24:
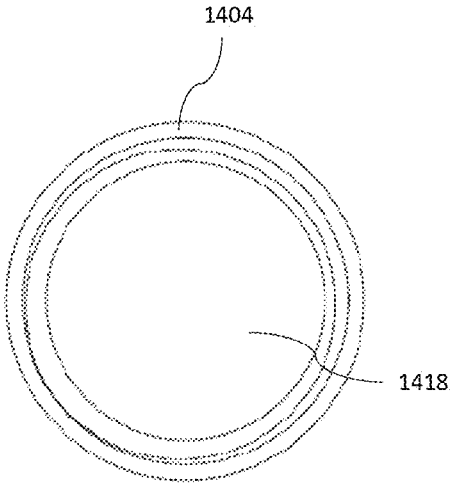
FIG. 24 illustrates a top view of the example combustible substance pod body shown in FIG. 23.
Figure 25:
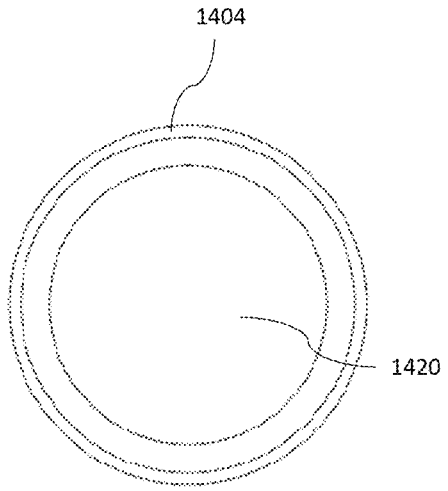
FIG. 25 illustrates a bottom view of the example combustible substance pod body shown in FIG. 23.
Figure 26:
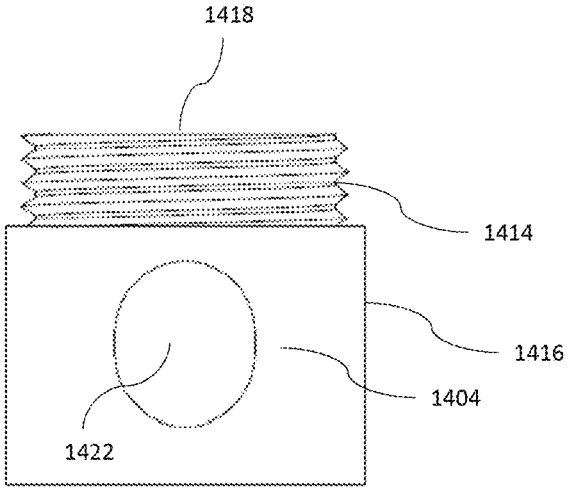
FIG. 26 illustrates a side view of the example combustible substance pod body shown in FIG. 23.
Figure 27:
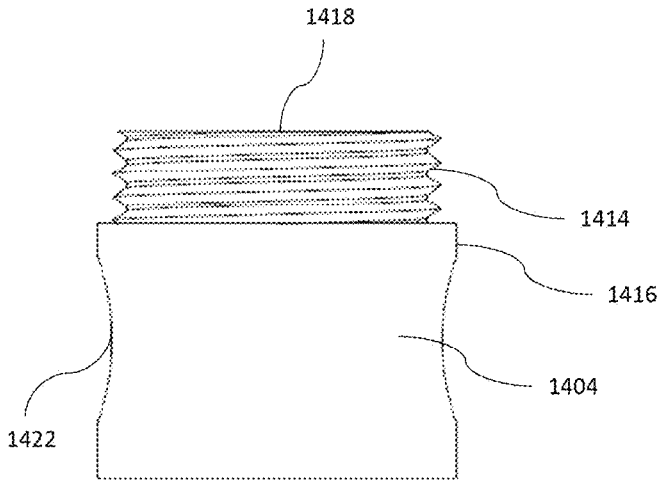
FIG. 27 illustrates another side view of the example combustible substance pod body shown in FIG. 23.

FIGS. 23-27 illustrate various views of another example pod body 1404 for a combustible substance pod in accordance with various embodiments herein. Pod body 1404 of FIG. 26 includes some or all of the features of the example pod body 1404 of FIG. 19. For example, the pod body 1404 may comprise an externally threaded narrow cylindrical portion 1414, a wide cylindrical portion 1416, a top opening 1418, and a bottom opening 1420. FIG. 23 illustrates a bottom perspective view of the example combustible substance pod body 1404 in accordance with various embodiments herein. FIG. 24 illustrates a top view of the example combustible substance pod body shown in FIG. 23. FIG. 25 illustrates a bottom view of the example combustible substance pod body shown in FIG. 23. FIG. 26 illustrates a side view of the example combustible substance pod body shown in FIG. 23. FIG. 27 illustrates another side view of the example combustible substance pod body shown in FIG. 23.

Unlike the example pod body of FIG. 19, example pod body 1404 of FIG. 23 comprises one or more side apertures 1422, which may allow a user to observe a combustible substance, smoke, or a lack thereof within a combustible substance pod. The example pod body 1402 comprises 2 side apertures 1422, located 180 degrees from each other. In some embodiments, a pod body according to various embodiments herein may comprise 1 or more than 2 side apertures. Furthermore, the placement, shape, number, orientation, and other characteristics of the side apertures may vary from the example shown. In embodiments comprising side apertures 1422, insertion of a transparent housing 1406 within the pod body may be necessary to prevent dislocation of a combustible substance from the pod.

Figure 28:
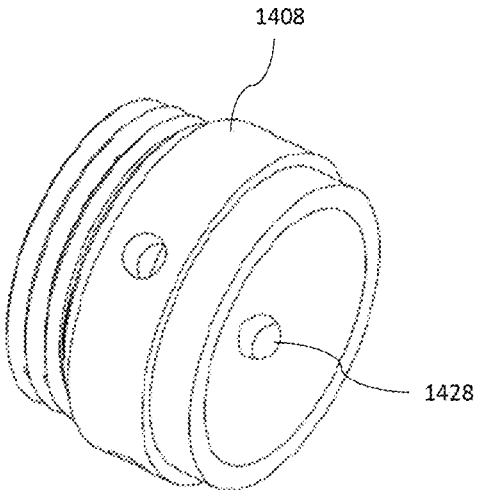
FIG. 28 illustrates a bottom perspective view of an example combustible substance pod insulator in accordance with various embodiments herein.
Figure 29:
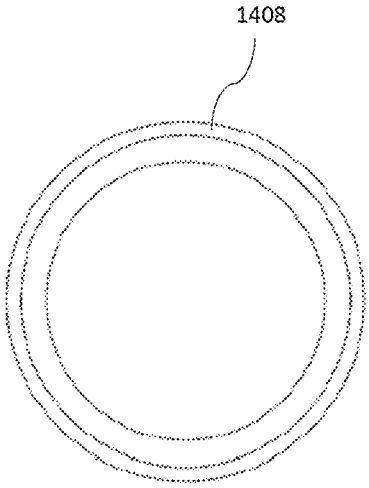
FIG. 29 illustrates a bottom view of the example combustible substance pod insulator shown in FIG. 28.
Figure 30:
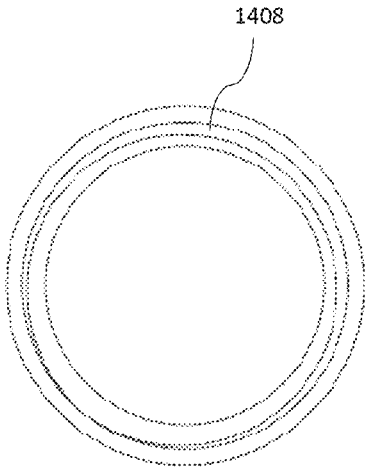
FIG. 30 illustrates a top view of the example combustible substance pod insulator shown in FIG. 28.
Figure 31:
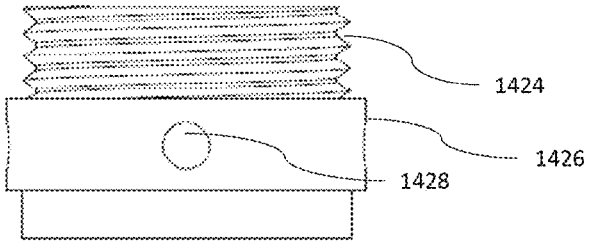
FIG. 31 illustrates a side view of the example combustible substance pod insulator shown in FIG. 28.
Figure 32:
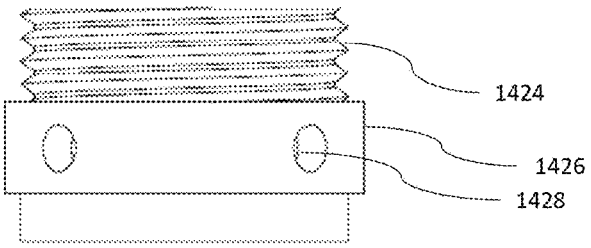
FIG. 32 illustrates another side view of the example combustible substance pod insulator shown in FIG. 28.

FIGS. 28-32 illustrate various views of an example electrode housing body 1408 for a combustible substance pod in accordance with various embodiments herein. FIG. 28 illustrates a bottom perspective view of the example combustible substance pod electrode housing body in accordance with various embodiments herein. FIG. 29 illustrates a bottom view of the example electrode housing body shown in FIG. 28. FIG. 30 illustrates a top view of the example electrode housing body shown in FIG. 28. FIG. 31 illustrates a side view of the example electrode housing body shown in FIG. 28. FIG. 32 illustrates another side view of the example electrode housing body shown in FIG. 28.

In some embodiments, the electrode housing body 1408 comprises a cylindrical exterior shape and an internal volume for containing a combustible substance. In some embodiments, the electrode housing body 1408 comprises a transparent material, such that a combustible substance therein can be viewed by a user. The electrode housing body 1408 may comprise a one or more narrow cylindrical portions 1424 and a wide cylindrical portion 1426. In some embodiments, the one or more narrow cylindrical portions 1424 may be threaded to couple with, for example, an end cap 1402 or other combustible substance pod component. In some embodiments, one or more of the narrow cylindrical portions 1424 can couple with or be configured for insertion into a cylindrical portion of for example, a pod body. For example, a non-threaded narrow cylindrical portion 1424 could be coupled to the wide cylindrical portion 1416 of example pod body 1404. In this manner, for example, the electrode housing body 1408, the pod body 1404, optionally a transparent housing 1406 and one or more end caps 1402 can be coupled or connected to form a combustible material pod or compartment in accordance to various embodiments herein.

In some embodiments, the electrode housing body 1408 comprises one or more electrode holes 1428 along the sidewall of the wide cylindrical portion 1426. The electrode holes 1428 are configured to house or contain electrodes connected to an electric circuit or electric combustion or ignition device. The electrodes can be inserted into the electrode holes 1428 to contact or remain proximate to a combustible substance, such that electric discharge of the electrodes results in ignition of the combustible substance. In some embodiments, the one or more electrodes can be permanently or semi-permanently affixed to the one or more electrode holes 1428. Because the electrodes can discharge a high-voltage electric shock, in some embodiments, the electrode housing body 1408 and other components of a combustible substance pod are formed from fire-resistant, electrically insulating, and non-leeching materials. In some embodiments, the electrode housing body 1408 and other components of a combustible substance pod are formed from stainless steel, glass, or durable plastic.

In some embodiments, the electrodes can discharge electricity from top to bottom or from bottom to top through the pod and ignite the combustible substance therein. In other embodiments, the electrodes can be located on the periphery of the combustible substance pod upon a horizontal plane. In some embodiments, the electrodes may slightly protrude from the exterior periphery of the combustible materials pod when inserted into the electrode housing body. In some embodiments, lowering the distance between electrodes reduces the voltage required to electrically ignite a combustible substance. Thus, in some embodiments, it may be useful to decrease the distance between electrodes or add additional electrodes.

The number, placement, orientation, and shape of the electrode holes 1428 can differ from the example embodiment shown. For example, electrode holes could be placed on the pod body, on other portions of the electrode housing body, on the end caps, or otherwise. Furthermore, a combustible materials pod according to various embodiments herein can have 2 or more electrodes. In some embodiments, the combustible materials pod can comprise 4 electrodes arranged on a horizontal plane around the circumference of the pod. The shape of the electrodes is not limited to the example embodiments shown.

Figure 33:
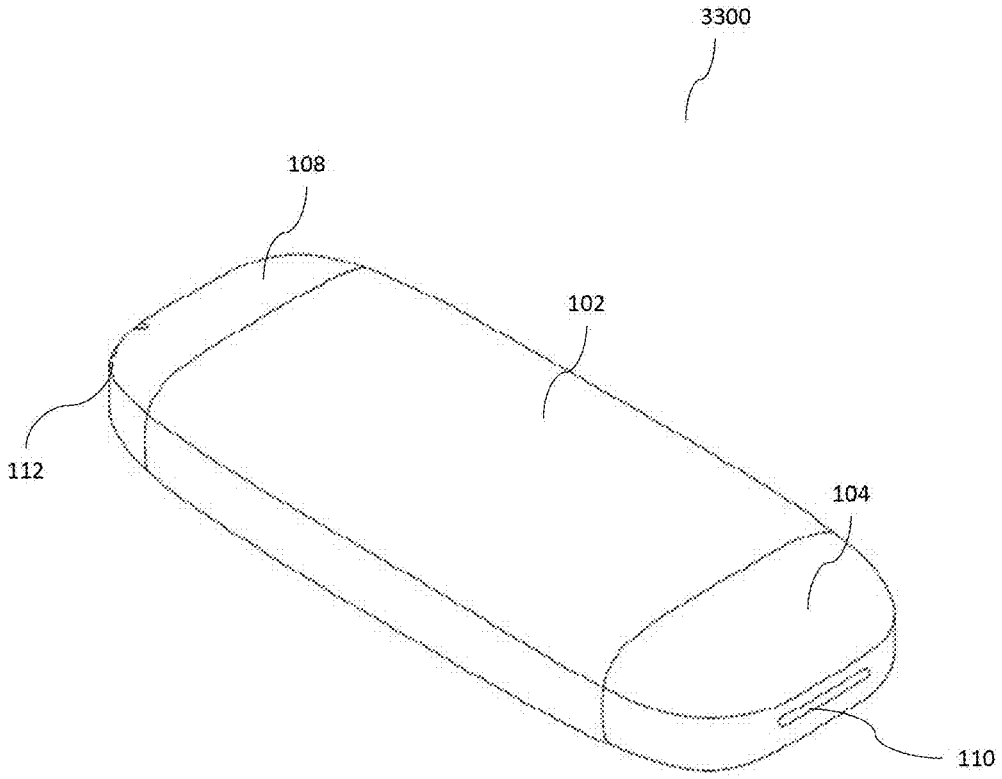
FIG. 33 illustrates a front perspective view of another example embodiment of a smoking device or system.
Figure 34:
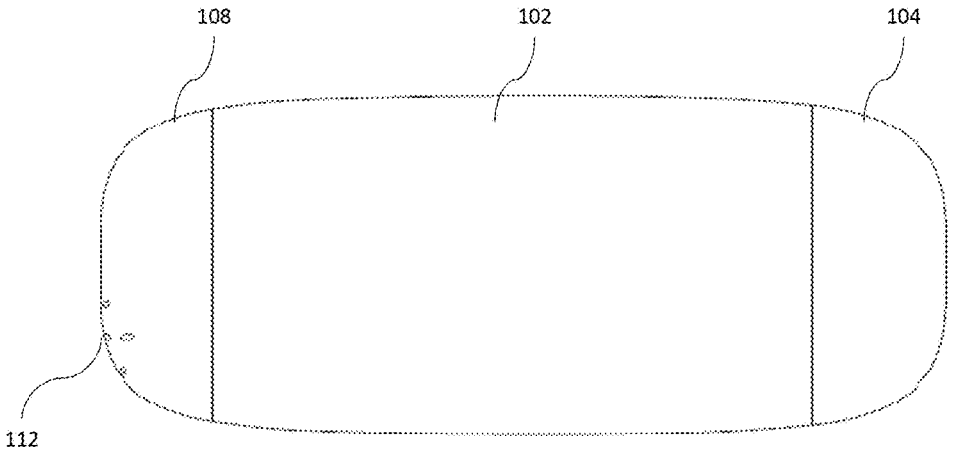
FIG. 34 illustrates a front view of the example embodiment of a smoking device or system of FIG. 33.

FIG. 33 illustrates a front perspective view of another example embodiment of a smoking device or system. The smoking system or device 3300 includes some or all of the features of the example smoking system or device 100 of FIG. 1 and 700 of FIG. 7. For example, the example smoking device or system 3300 includes a body 102, a top lid 104, an ignition button 106, a bottom lid 108, one or more openings or smoke outlets 110, and one or more air inlet holes 112. FIG. 34 illustrates a front view of the example embodiment of a smoking device or system of FIG. 33.

Figure 35:
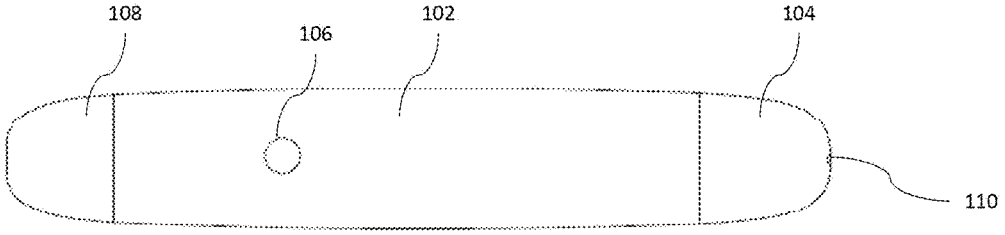
FIG. 35 illustrates a side view of the example embodiment of a smoking device or system of FIG. 33.

FIG. 35 illustrates a side view of the example embodiment of a smoking device or system of FIG. 33. The shape and placement of the ignition button 106 can be altered from the embodiments shown herein. For example, the ignition button 106 could be located on the other side of the smoking system, the top lid, the bottom lid, or otherwise.

Figure 36:
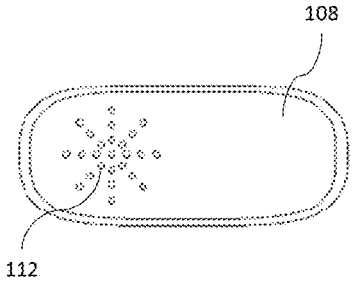
FIG. 36 illustrates a bottom view of the example embodiment of a smoking device or system of FIG. 33.

FIG. 36 illustrates a bottom view of the example embodiment of a smoking device or system of FIG. 33. The number, configuration, placement, and shape of the air inlet holes of all the devices or systems herein may be varied. For example, as shown in FIG. 36, there may be air inlet holes 112 arranged in a concentric circle configuration.

Figure 37:
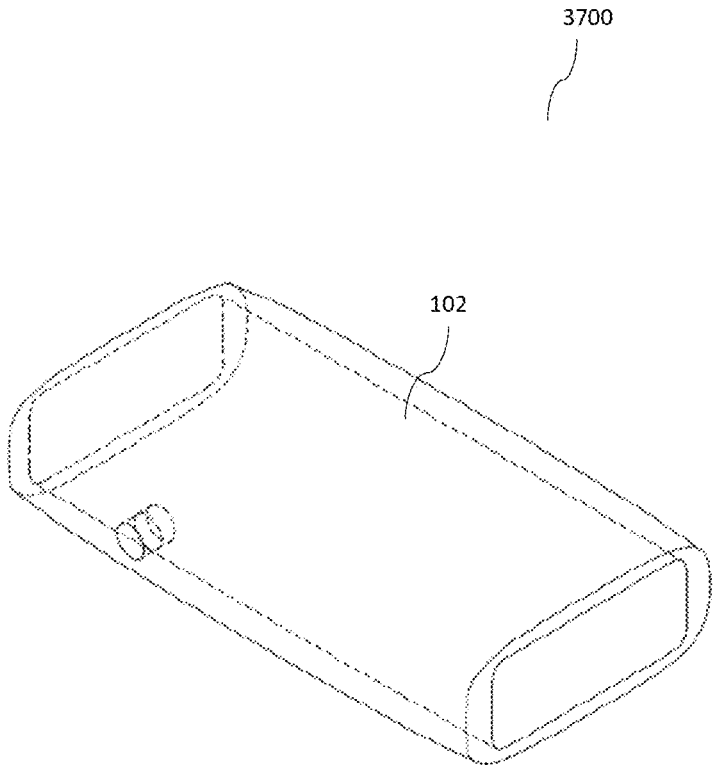
FIG. 37 illustrates a front perspective view of another example embodiment of a smoking device or system with the top and bottom lids removed.

FIG. 37 illustrates a front perspective view of another example embodiment of a smoking device or system with the top and bottoms lids and ignition button removed. The smoking system or device 3700 includes some or all of the features of the example smoking system or device 100 of FIG. 1, 700 of FIG. 7, and 3300 of FIG. 33. For example, the example smoking device or system 3300 includes a body 102. In some embodiments, the body of the smoking devices or systems herein can comprise a casing, which may comprise various hollow compartments for containing the various internal components of the device or system. For example, the body may have one continuous compartment or may have a plurality of connected or isolated compartments for holding the components of the device or system (e.g. combustible substance pod, battery, etc.).

Figure 38:
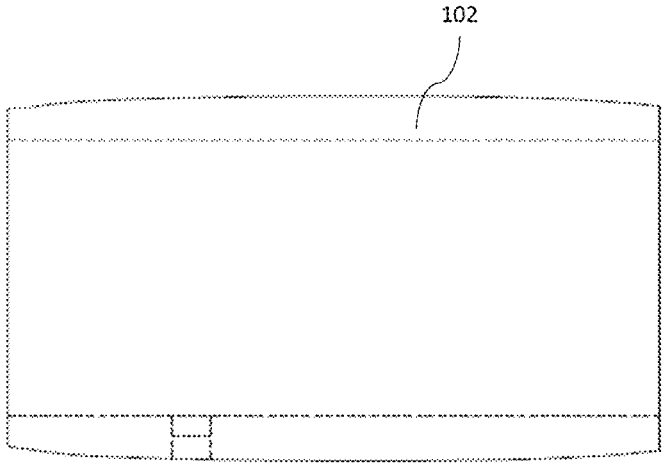
FIG. 38 illustrates a front view of the example embodiment of a smoking device or system of FIG. 37.
Figure 39:
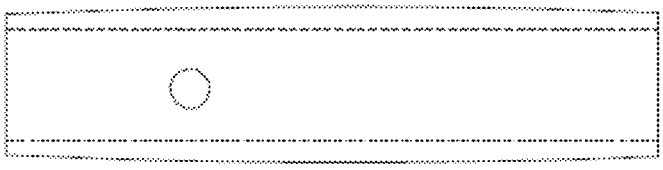
FIG. 39 illustrates a side view of the example embodiment of a smoking device or system of FIG. 37.
Figure 40:
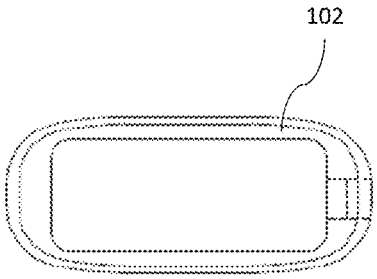
FIG. 40 illustrates a bottom view of the example embodiment of a smoking device or system of FIG. 37.

FIG. 38 illustrates a front view of the example embodiment of a smoking device or system of FIG. 37. FIG. 39 illustrates a side view of the example embodiment of a smoking device or system of FIG. 37. FIG. 40 illustrates a bottom view of the example embodiment of a smoking device or system of FIG. 37.

Figure 41:
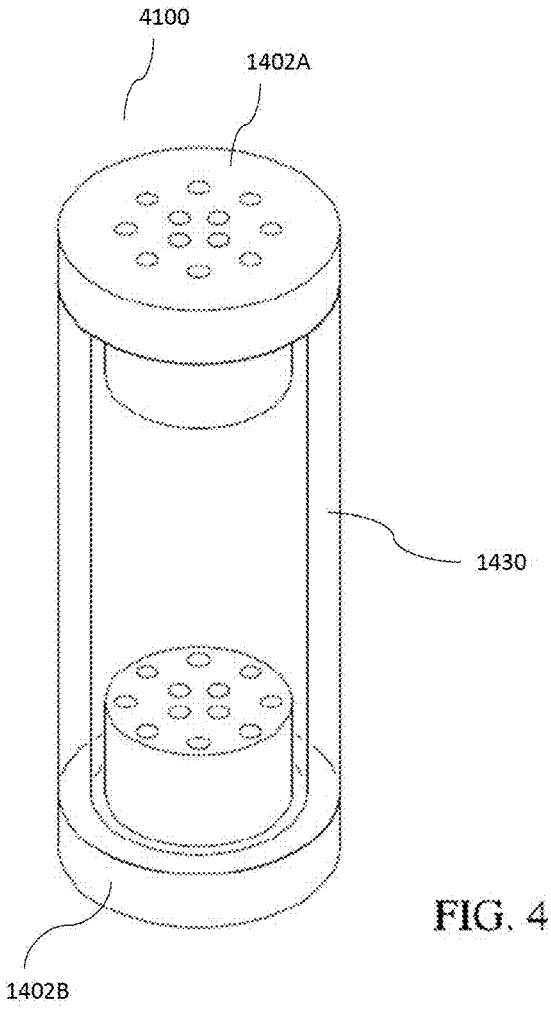
FIG. 41 illustrates a top perspective view of another example combustible substance pod in accordance with various embodiments herein.

FIG. 41 illustrates a top perspective view of another example combustible substance pod in accordance with various embodiments herein. The combustible substance pod 4100 includes some or all of the features of the example combustible substance pod 1400, including, for example, a top end cap 1402A and a bottom end cap 1402B. As shown in FIG. 41, a one-piece combustible substance pod body 1430 may be transparent such that a combustible substance can be observed therein. The example combustible substance pod 4100 comprises a one-piece combustible substance pod body 1430 enclosed by two end caps 1402. The pod body 1404, transparent housing 1406, and electrode housing structure 1408 can be combined into a one-piece combustible substance pod body 1430 having some or all of the combined features of those structures. Combining the various structures may reduce manufacturing time, difficulty, and complications, increase ease of use, or otherwise enhance the usability and convenience of a combustible substance pod.

The top end cap 1402A and the bottom end cap 1402B may comprise one or more air holes 1410 to allow air and smoke to move in and out of the combustible substance pod 4100. Excluding the air holes 1410, the top end cap 1402A and the bottom end cap 1402B may form a substantially air-tight seal with the one-piece combustible substance pod body 1430 when coupled. Thus, in some embodiments, air and smoke are transferred into and out of the pod through the air holes 1410.

Figure 42:
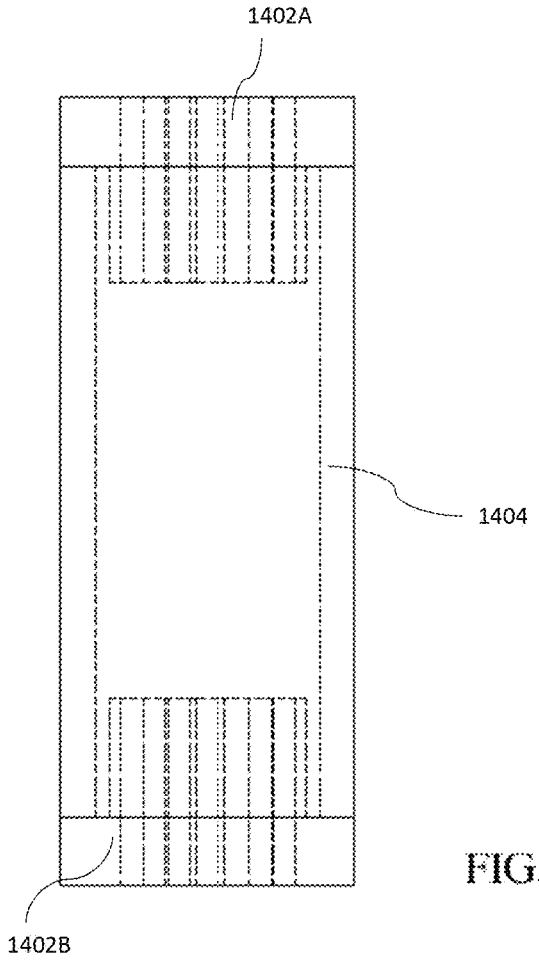
FIG. 42 illustrates a side view of the example combustible substance pod shown in FIG. 41.

FIG. 42 illustrates a side view of the example combustible substance pod shown in FIG. 41. As shown, the air holes in the top end cap 1402A and the bottom end cap 1402B extend all the way through the height of the caps, such that air and smoke from inside the pod body can exit, and air and smoke from outside the pod can enter.

Figure 43:
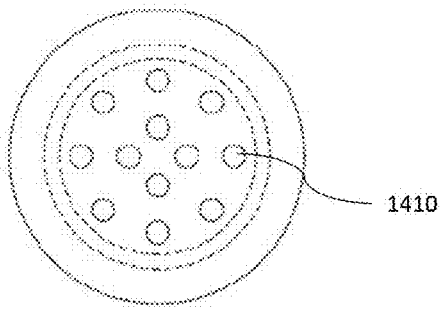
FIG. 43 illustrates a top view of the example combustible substance pod shown in FIG. 41.

FIG. 43 illustrates a top view of the example combustible substance pod shown in FIG. 41. The air holes 1410 of the top end cap 1402A and the bottom end cap 1402B may vary in number, configuration, and placement in order to optimize air flow and reduce dislocation of loose-leaf products, combustible materials, or ash from the interior of the pod.

Figure 44:
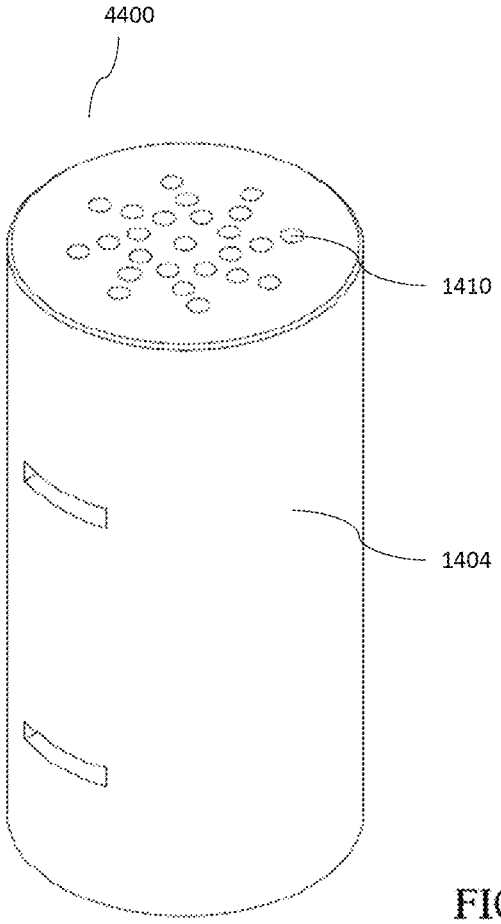
FIG. 44 illustrates a top perspective view of another example combustible substance pod in accordance with various embodiments herein.
Figure 45:
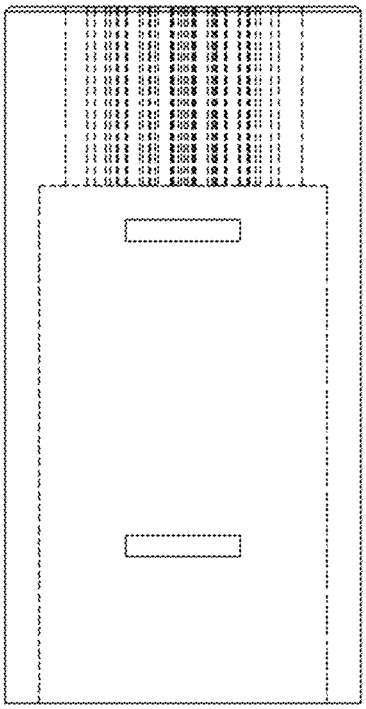
FIG. 45 illustrates a side view of the example combustible substance pod shown in FIG. 44.
Figure 46:
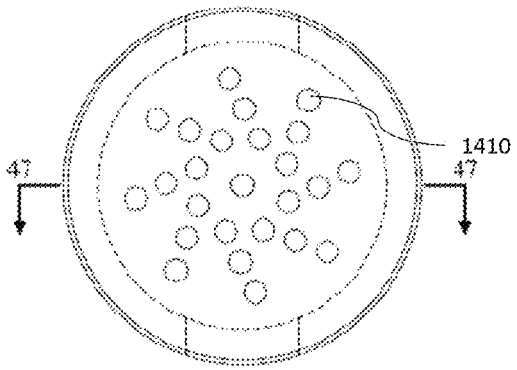
FIG. 46 illustrates a top view of the example combustible substance pod shown in FIG. 44.
Figure 47:
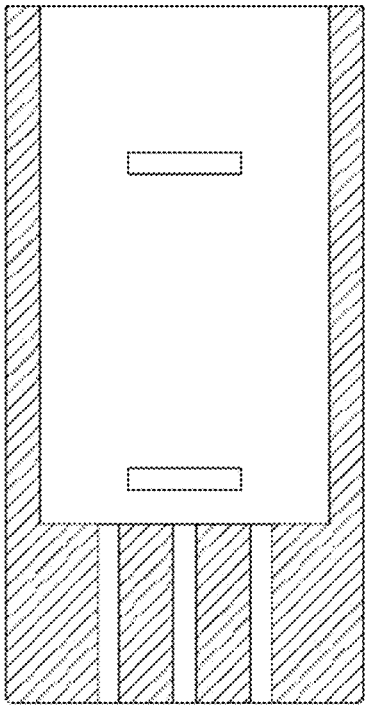
FIG. 47 illustrates a cross sectional side view of the example combustible substance pod shown in FIG. 44-46, along the line 47 of FIG. 46.
Figure 48:
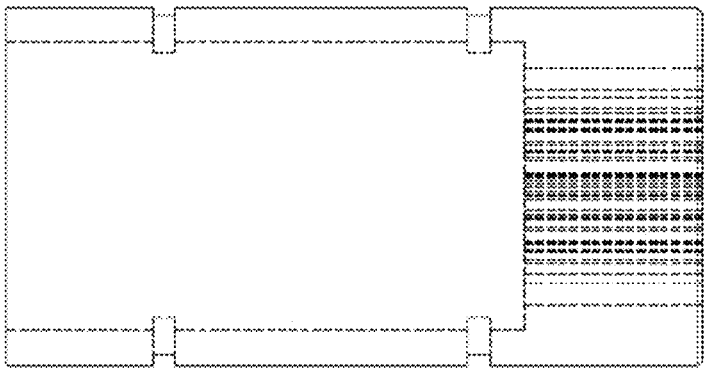
FIG. 48 illustrates another side view of the example combustible substance pod shown in FIG. 44.

FIG. 44 illustrates a top perspective view of another example combustible substance pod in accordance with various embodiments herein. The combustible substance pod 4400 includes some or all of the features of the example combustible substance pod 1400 and 4100, including a plurality of air holes 1410 and a one-piece combustible substance pod body 1430. FIG. 45 illustrates a side view of the example combustible substance pod shown in FIG. 44. FIG. 46 illustrates a top view of the example combustible substance pod shown in FIG. 44. FIG. 47 illustrates a cross sectional side view of the example combustible substance pod shown in FIG. 44-46, along the line 47 of FIG. 46. FIG. 48 illustrates another side view of the example combustible substance pod shown in FIG. 44.

Figure 49:
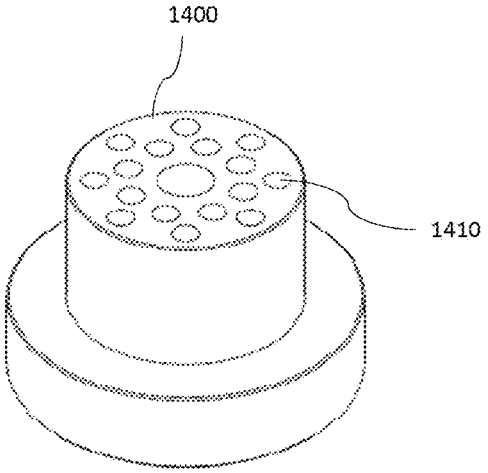
FIG. 49 illustrates a top perspective view of another example end cap for a combustible substance pod in accordance with various embodiments herein.
Figure 50:
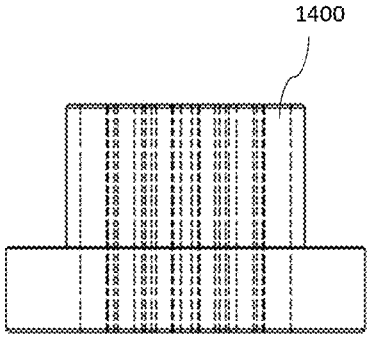
FIG. 50 illustrates a side view of the example end cap for a combustible substance pod shown in FIG. 49.
Figure 51:
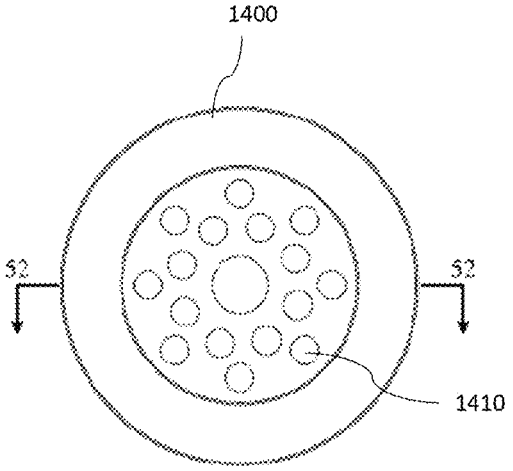
FIG. 51 illustrates a top view of the example end cap for a combustible substance pod shown in FIG. 49.
Figure 52:
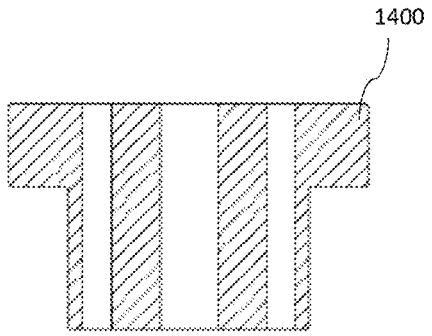
FIG. 52 illustrates a cross-sectional view of the example end cap for a combustible substance pod shown in FIG. 49-50, along the line 52 of FIG. 51.

FIGS. 49-52 illustrate various views of another example end cap 1402 for use with a smoking device or systems according to various embodiments herein. FIG. 49 illustrates a top perspective view of another example end cap for a combustible substance pod in accordance with various embodiments herein. The example end cap of FIG. 49 includes some or all of the features of the example end cap of FIG. 15. One or more end caps 1402 can be coupled with, for example, a pod body 1404 or one-piece combustible substance pod body 1430 to form a combustible substance pod. End cap 1402 may comprise one or more air holes 1410, to allow air and smoke to enter and exit a combustible substance pod. The number, configuration, and placement of the air holes may vary in order to optimize air flow and reduce dislocation of loose-leaf products, combustible materials, or ash from the interior of the pod. FIG. 50 illustrates a side view of the example end cap 1402 for a combustible substance pod shown in FIG. 49. As shown, the air holes 1410 in the example end cap 1402 extend all the way through the height of the caps, such that air and smoke from inside the pod body can exit, and air and smoke from outside the pod can enter. FIG. 51 illustrates a top view of the example end cap for a combustible substance pod shown in FIG. 49. FIG. 52 illustrates a cross-sectional view of the example end cap for a combustible substance pod shown in FIG. 49-50, along the line 52 of FIG. 51.

Figure 53:
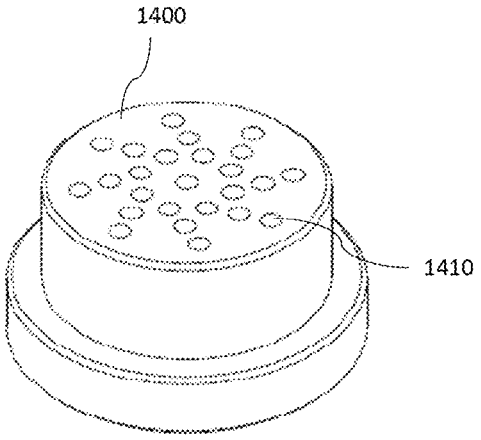
FIG. 53 illustrates a top perspective view of another example end cap for a combustible substance pod in accordance with various embodiments herein.
Figure 54:
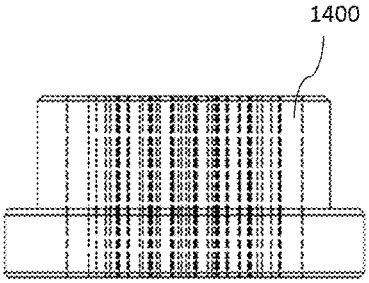
FIG. 54 illustrates a side view of the example end cap for a combustible substance pod shown in FIG. 53.
Figure 55:
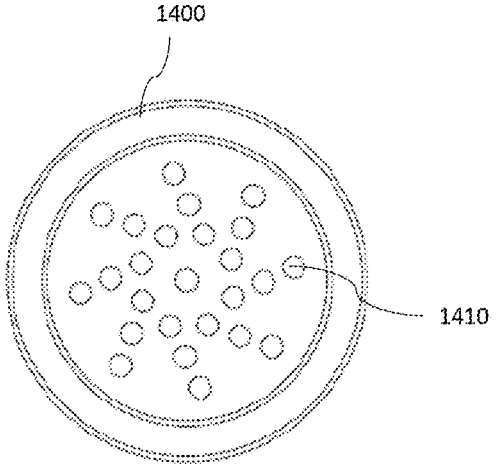
FIG. 55 illustrates a top view of the example end cap for a combustible substance pod shown in FIG. 53.

FIGS. 53-55 illustrate various views of another example end cap 1402 for use with a smoking device or systems according to various embodiments herein. FIG. 53 illustrates a top perspective view of the example end cap 1402 for a combustible substance pod in accordance with various embodiments herein. The example end cap 1402 includes some or all of the features of the example end cap of FIG. 15 and of FIG. 49. One or more end caps 1402 can be coupled with, for example, a pod body such as the example pod body 1404 to form a combustible substance pod. End cap 1402 may comprise one or more air holes 1410, to allow air and smoke to enter and exit a combustible substance pod. The number, configuration, and placement of the air holes may vary in order to optimize air flow and reduce dislocation of loose-leaf products, combustible materials, or ash from the interior of the pod. FIG. 54 illustrates a side view of the example end cap for a combustible substance pod shown in FIG. 53. As shown, the air holes 1410 in the example end cap 1402 extend all the way through the height of the caps, such that air and smoke from inside the pod body can exit, and air and smoke from outside the pod can enter. FIG. 55 illustrates a top view of the example end cap for a combustible substance pod shown in FIG. 53.

Figure 56:
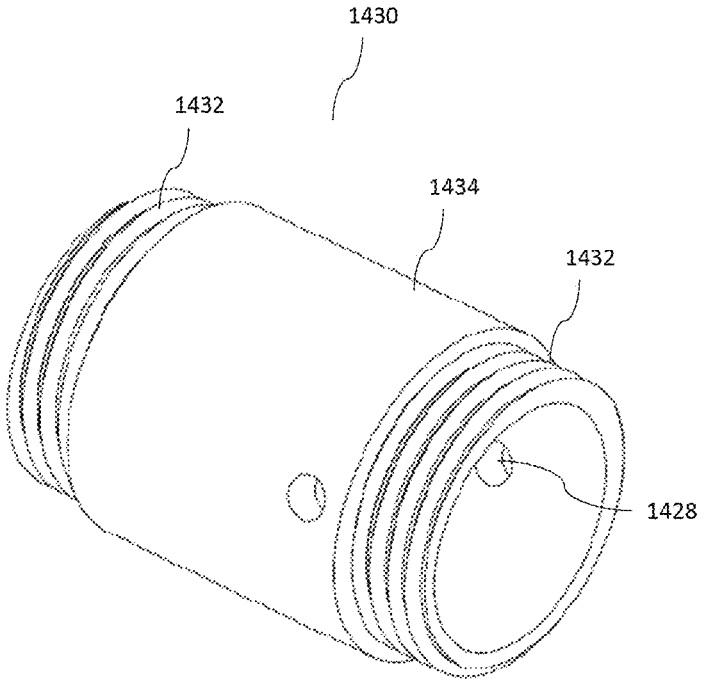
FIG. 56 illustrates a bottom perspective view of an example one-piece combustible substance pod body/insulator in accordance with various embodiments herein.

FIGS. 55-60 illustrates various views of an example one-piece combustible substance pod body 1430. FIG. 56 illustrates a bottom perspective view of an example one-piece combustible substance pod body/insulator/electrode housing structure 1430 in accordance with various embodiments herein. The one-piece pod body 1430 may combine the features of the pod bodies 1404, transparent housings 1406, and electrode housing structures 1408 disclosed herein. Those features may be combined into one structure for ease of manufacturing, use, or enhancement of convenience and usability.

The one-piece pod body 1430 may comprise two externally threaded narrow cylindrical portions 1432, which may couple or otherwise fasten to one or more end caps 1402, such that the device is sealed from the outside, excluding the air holes in the end caps. The one-piece pod body 1430 may also comprise a wide cylindrical portion 1434 in between the two narrow cylindrical portions 1432. The interior of the one-piece combustible substance pod body 1430 defines a volume when the body is coupled with two end caps, the volume configured to contain a combustible substance.

Figure 57:
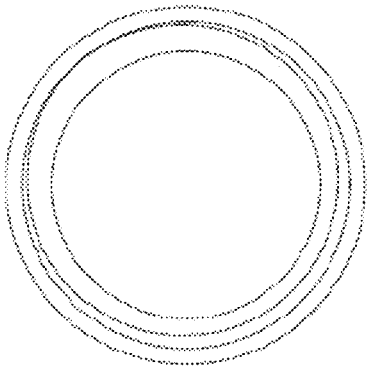
FIG. 57 illustrates a top view of the example one-piece combustible substance pod body/insulator shown in FIG. 56.
Figure 58:
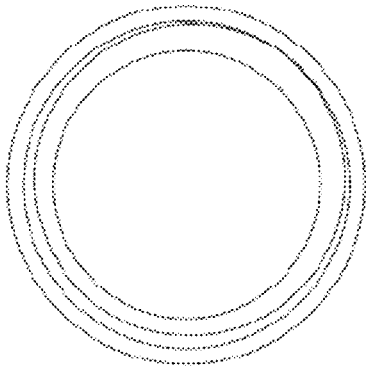
FIG. 58 illustrates a bottom view of the example one-piece combustible substance pod body/insulator shown in FIG. 56.
Figure 59:
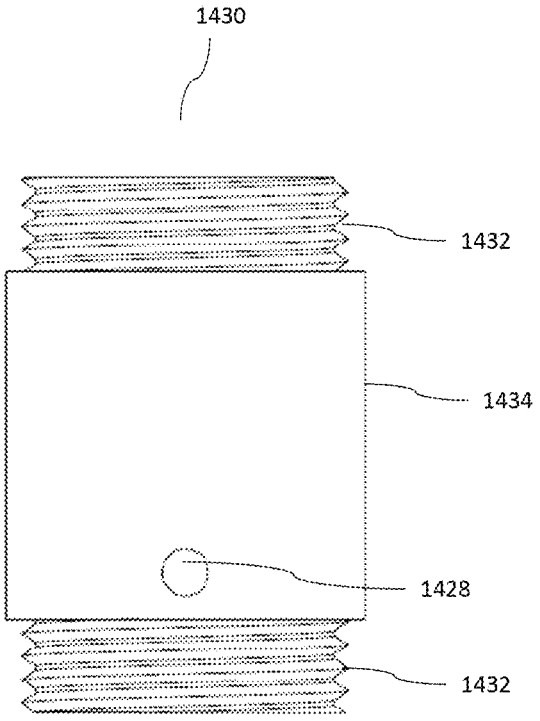
FIG. 59 illustrates a side view of the example one-piece combustible substance pod body/insulator shown in FIG. 56.
Figure 60:
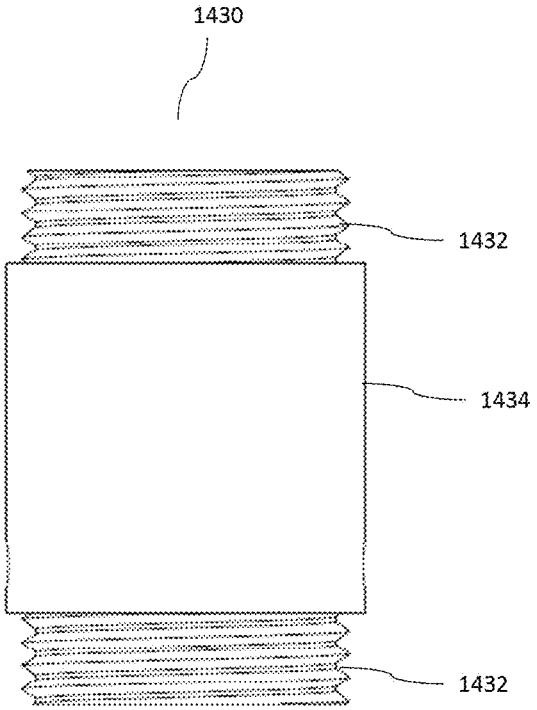
FIG. 60 illustrates another side view of the example one-piece combustible substance pod body/insulator shown in FIG. 56.

The one-piece pod body 1430 may comprise one or two or more electrode holes 1428, configured to house electrodes of an electronic ignition or combustion device. The electrodes can be inserted into the electrode holes 1428 to contact or remain proximate to a combustible substance, such that electric discharge of the electrodes results in ignition of the combustible substance. Because the electrodes can discharge a high-voltage electric shock, in some embodiments, the one-piece combustible substance pod body 1430 and other components of a combustible substance pod are formed from fire-resistant, electrically insulating, and non-leeching materials. In some embodiments, the one-piece pod body 1430 and other components of a combustible substance pod are formed from stainless steel, glass, or durable plastic. FIG. 57 illustrates a top view of the example one-piece combustible substance pod body/insulator shown in FIG. 56. FIG. 58 illustrates a bottom view of the example one-piece combustible substance pod body/insulator shown in FIG. 56. FIG. 59 illustrates a side view of the example one-piece combustible substance pod body/insulator shown in FIG. 56. FIG. 60 illustrates another side view of the example one-piece combustible substance pod body/insulator shown in FIG. 56.

Figure 61:
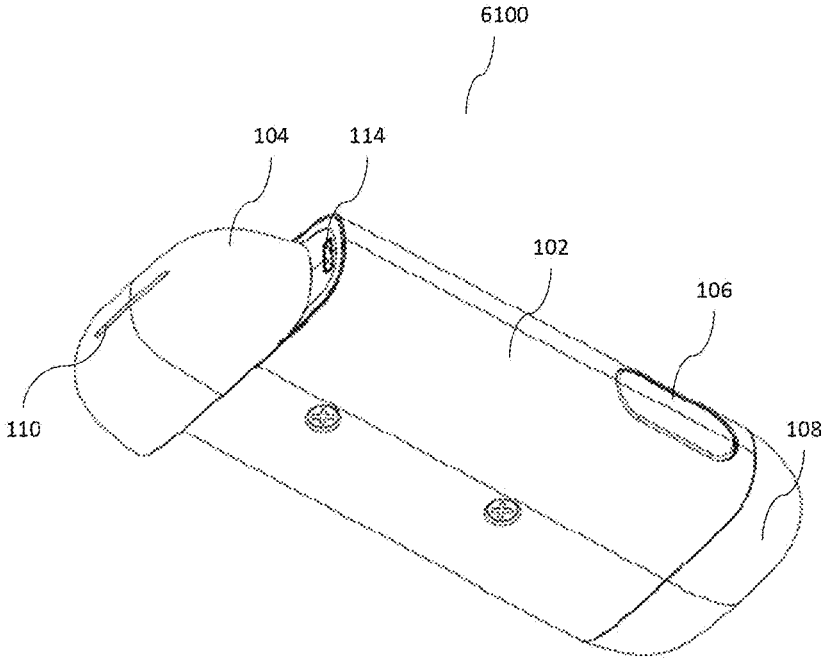
FIG. 61 illustrates a rear perspective view of another example embodiment of a smoking device or system in accordance with various embodiments herein.

FIG. 61 illustrates a rear perspective view of another example embodiment of a smoking device or system 6100 in accordance with various embodiments herein. The smoking system or device 6100 includes some or all of the features of the example smoking system or device 100 of FIG. 1, 700 of FIG. 7, 3300 of FIG. 33, and 3700 of FIG. 37. For example, the example smoking device or system 3700 includes a body 102, a top lid 104, an ignition button 106, and a bottom lid 108. In some embodiments, the bodies of the smoking devices or systems herein can comprise a casing, which may comprise various hollow compartments for containing the various internal components of the device or system. For example, the body may have one continuous compartment or may have a plurality of connected or isolated compartments for holding the components of the device or system (e.g. combustible substance pod, battery, etc.). As shown in FIG. 61, the top lid 104 may be configured to slide laterally to reveal a charging port 114, which may be used to charge an internal battery when connected to external power.

Figure 62:
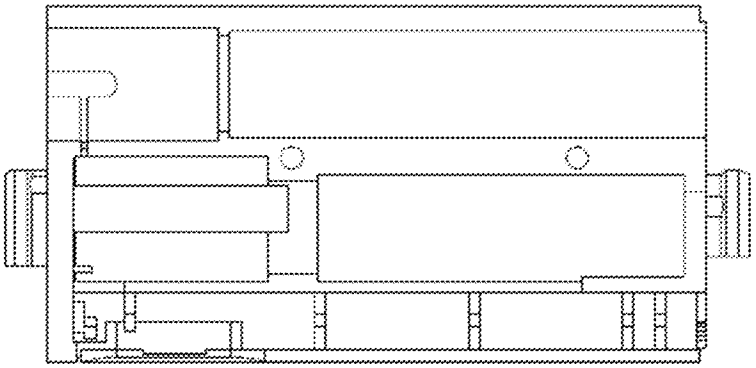
FIG. 62 illustrates a side view of the internal compartments of an example smoking device or system in accordance with various embodiments herein.
Figure 63:
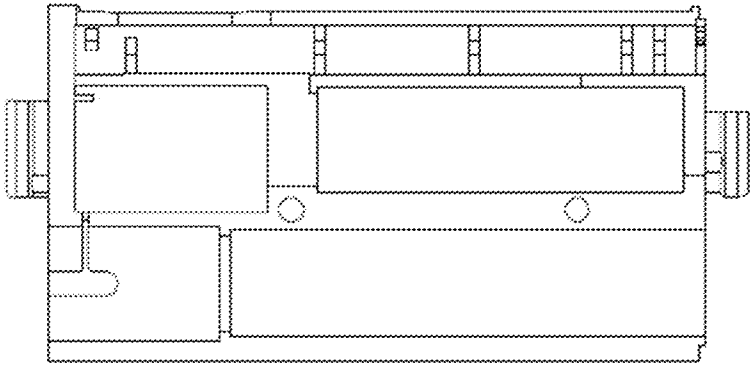
FIG. 63 illustrates a side view of the internal compartments of an example smoking device or system in accordance with various embodiments herein.

FIG. 62 illustrates a side view of the internal compartments of an example smoking device or system in accordance with various embodiments herein. FIG. 63 illustrates another side view of the internal compartments of an example smoking device or system in accordance with various embodiments herein. Each of the internal compartments may be configured to house the internal components of the smoking devices or systems described herein, including for example, a combustible substance pod, battery, electronic ignition device, transformer, processor, fan or micro-fan, insulating features, or other mechanical or electrical components.

Figure 64:
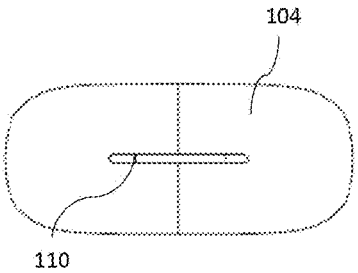
FIG. 64 illustrates a top view of an example top lid for a smoking device or system in accordance with various embodiments herein.

FIG. 64 illustrates a top view of an example top lid 104 for a smoking device or system in accordance with various embodiments herein. In some embodiments, the top lid 6400 comprises one or more openings or smoke outlets 110, configured to allow air and smoke to be drawn from inside a smoking device or system. The number, placement, configuration, and size of the one or more openings or smoke outlets 110 can be varied to optimize air flow or to suit the needs of different users. In some embodiments, the top lid 104 may be configured to slide laterally, revealing a charging port 114 configured to charge a battery within the smoking system or device, when connected to an external power source, and/or activating a mechanism for releasing a combustible substance pod from the system or device.

Figure 65:
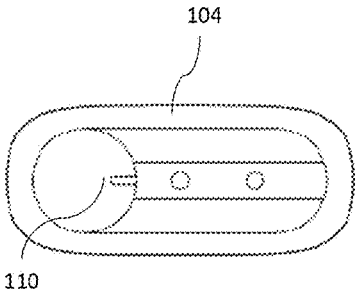
FIG. 65 illustrates bottom view of the example top lid shown in FIG. 64.

FIG. 65 illustrates bottom view of the example top lid shown in FIG. 64.

Figure 66:
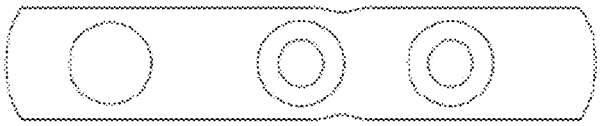
FIG. 66 illustrates an example mouthpiece component for a smoking device or system in accordance with various embodiments herein.

FIG. 66 illustrates an example mouthpiece component for a smoking device or system in accordance with various embodiments herein.

Figure 67:
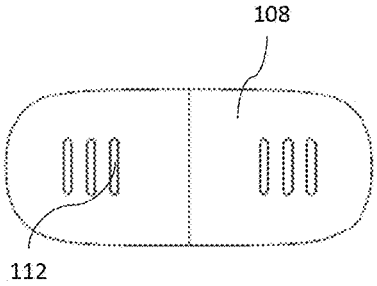
FIG. 67 illustrates a bottom view of an example bottom lid for a smoking device or system in accordance with various embodiments herein.
Figure 68:
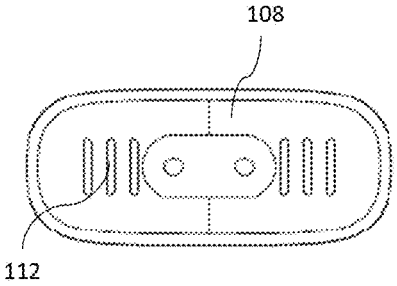
FIG. 68 illustrates a top view of the example bottom lid shown in FIG. 67.

FIG. 67 illustrates a bottom view of an example bottom lid 108 for a smoking device or system in accordance with various embodiments herein. FIG. 68 illustrates a top view of the example bottom lid 108 shown in FIG. 67. In some embodiments, the bottom lid 108 may comprise one or more air inlets 112, configured to allow air to enter the bottom of a smoking device or system. For example, when a user draws air or smoke out, for example, an opening or smoke outlet of top lid 104, air can enter the bottom lid 108 through the one or more air inlets 112. The number, placement, configuration, and size of the one or more air inlets 112 can be varied to optimize air flow.

Figure 69:
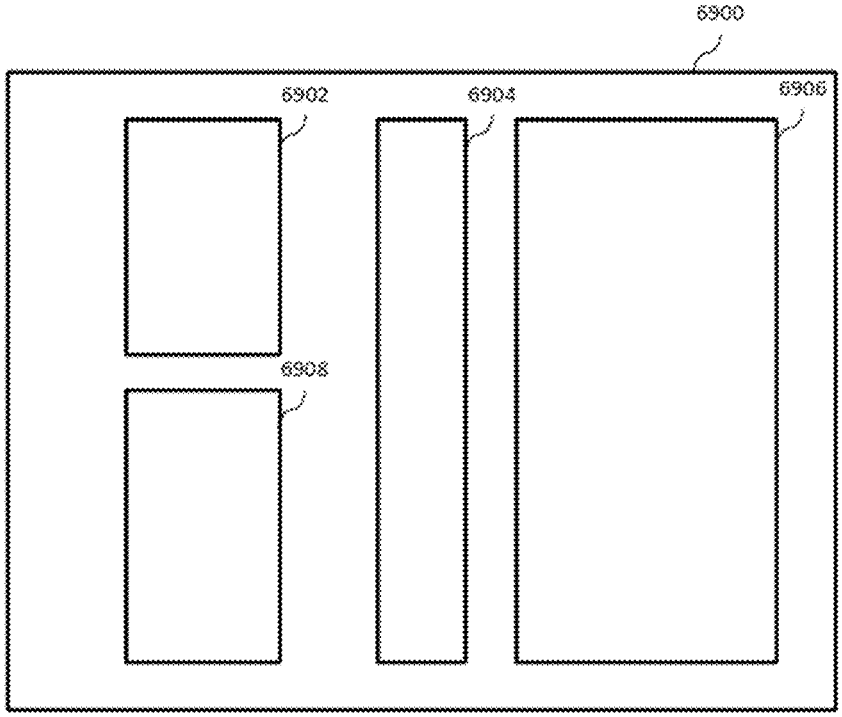
FIG. 69 illustrates a schematic diagram of the internal configuration of an example smoking system or device in accordance with various embodiments herein.

FIG. 69 illustrates a schematic diagram of the internal configuration of an example smoking system or device in accordance with various embodiments herein. The smoking a system or device 6900 may comprise a combustible substance pod 6902, an insulating wall, material, or device 6904, a battery 6906, and an electronic ignition device 6908. The combustible substance pod 6902 may be constructed in accordance to any of the embodiments disclosed herein or otherwise, and can be configured to contain a combustible substance or loose-leaf product. The insulating wall, material, or device 6904 may protect the battery 6906 and other internal components of the device from heat generated from the electronic ignition device 6908 or from a combustion reaction occurring within the combustible substance pod 6902. The insulating or insulation wall 6904 may be located between the battery and the removable combustible substance pod, wherein the insulation wall is configured to control or prevent heat flow from the combustible substance pod to the battery. The electronic ignition device 6908 may be a high-voltage electronic arc device that may comprise one or more electrodes that generate an electronic discharge which may ignite the combustible material inside the combustible substance pod 6902.

Figure 70:
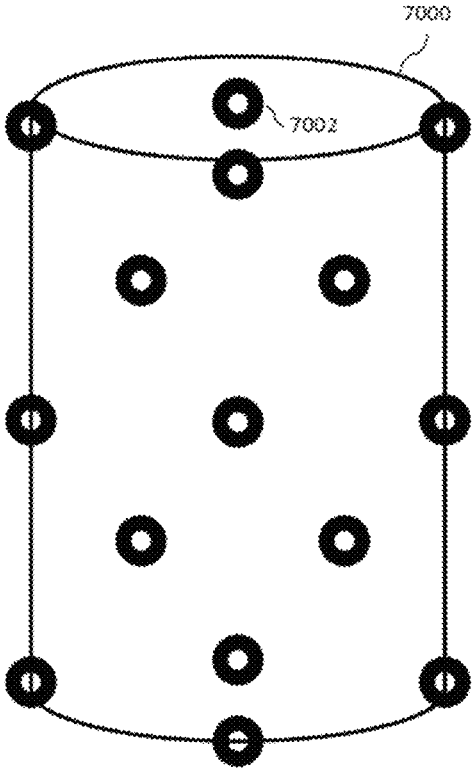
FIG. 70 illustrates a schematic diagram of an example combustible substance pod electrode configuration.

FIG. 70 illustrates a schematic diagram of an example combustible substance pod electrode configuration. The example combustible substance pod 7000 may be constructed in accordance to any of the embodiments disclosed herein or otherwise, and can be configured to contain a combustible substance or loose-leaf product. The combustible substance pod 7000 comprises one or more electrode holes 7002 for housing one or more electrodes. The configuration of electrode holes 7002 and thus, electrodes, in the combustible substance pod 7000 can vary. For example, the combustible substance pod 7000 can have comprise some or all of the electrode holes 7002 shown in FIG. 70, or it may have electrodes holes in any other conceivable location on the pod. For example, the electrodes holes 7002 and electrodes can be located on the top surface, bottom surface, or sidewalls of the pod. In some embodiments, a smaller distance between subsequent electrodes can reduce the voltage required to produce an igniting electronic discharge. The electrode holes 7002 of the example combustible substance pod 7000 can be similar or identical in shape, placement, configuration, and number, as the electrode holes 1428 described in reference to various embodiments herein.

Figure 71:
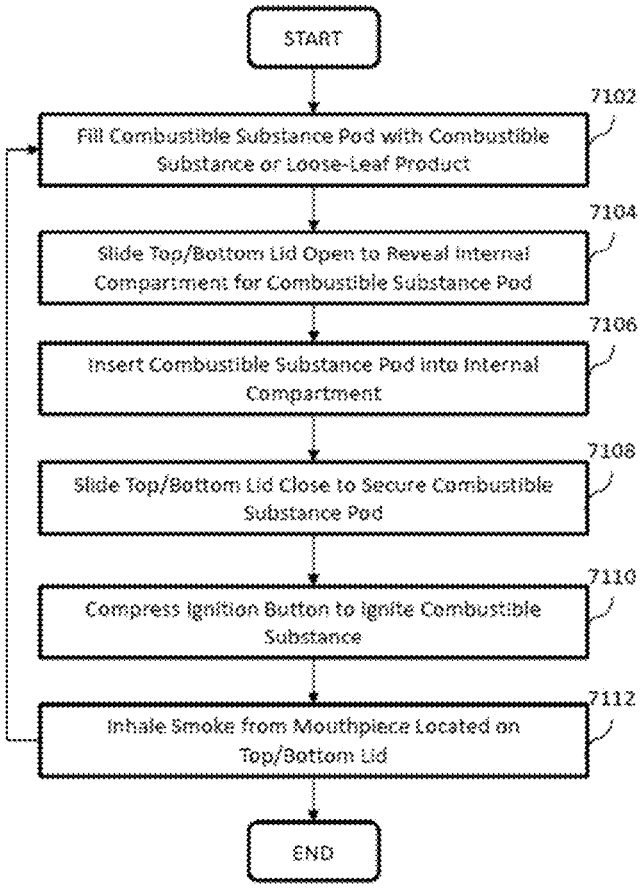
FIG. 71 illustrates a flowchart of an example process for using a smoking device or system according to various embodiments herein.

FIG. 71 illustrates a flowchart of an example process for using a smoking device or system according to various embodiments herein. In some embodiments, a user may fill a combustible substance pod or other compartment with a combustible substance or loose-leaf product (7102). In some embodiments, the user may slide open a top or bottom lid of a smoking device or system to reveal an internal compartment for housing the combustible substance pod or other compartment (7104). In some embodiments, the user may insert the combustible substance pod or other compartment into the internal compartment (7106). In some embodiments, the user may slide close the top or bottom lid of the smoking device or system, securing the combustible substance pod or other compartment within the device or system (7108). In some embodiments, the user may compress an ignition button to activate an ignition device, for example, a high-voltage electric arc, configured to ignite the combustible substance or loose-leaf product within the combustible substance pod or other compartment (7110). In some embodiments, the user may inhale from a mouthpiece located on the top or bottom lid of the smoking device or system to inhale smoke generated from combustion of the combustible substance or loose-leaf product (7112). In some embodiments, the user may continue igniting and inhaling smoke until the combustible substance is depleted. In some embodiments, the user can remove the combustible substance pod upon partial or complete depletion of a combustible substance, empty and/or clean the pod, and refill the combustible substance pod (7102) to restart the smoking process.

In some embodiments, the smoking system or device may comprise various control features, such as a fan controller, or a heat and temperature controller as described herein. Furthermore, the smoking system or device may comprise one or more transmitters, data interfaces, and/or wireless communication modules configured to allow the systems of smoking device or system to interact with, for example a mobile or computer application. For example, a mobile or computer application may be used to control the fan speed or temperature threshold of the device, or, in conjunction with one or more sensors, determine and display the amount of remaining combustible substance or loose-leaf product remaining in the smoking device or system. In some embodiments, the smoking system or device may comprise, for example, a PIC microprocessor to control the duty cycle, manage safety features, and/or control the transformer control frequency.

Figure 72:
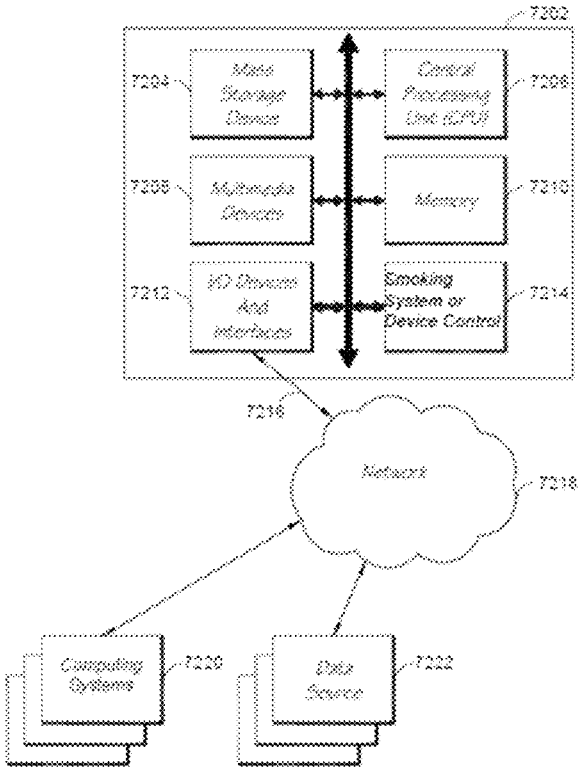
FIG. 72 is a block diagram depicting an embodiment of a computer hardware system configured to run software for implementing one or more embodiments of the smoking systems, methods, and devices disclosed herein.

FIG. 72 is a block diagram depicting an embodiment of a computer hardware system configured to run software for implementing one or more embodiments of the smoking systems, methods, and devices disclosed herein.

In some embodiments, the systems, processes, and methods described herein are implemented using a computing system, such as the one illustrated in FIG. 72. The example computer system 7202 is in communication with one or more computing systems 7220 and/or one or more data sources 7222 via one or more networks 7218. While FIG. 72 illustrates an embodiment of a computing system 7202, it is recognized that the functionality provided for in the components and modules of computer system 7202 may be combined into fewer components and modules, or further separated into additional components and modules.

The computer system 7202 can comprise a smoking system or device control module 7214 that carries out the functions, methods, acts, and/or processes described herein. The smoking system or device control module 7214 is executed on the computer system 7202 by a central processing unit 7206 discussed further below.

In general, the word "module," as used herein, refers to logic embodied in hardware or firmware or to a collection of software instructions, having entry and exit points. Modules are written in a program language, such as JAVA, C or C++, PYPHON or the like. Software modules may be compiled or linked into an executable program, installed in a dynamic link library, or may be written in an interpreted language such as BASIC, PERL, LUA, or Python. Software modules may be called from other modules or from themselves, and/or may be invoked in response to detected events or interruptions. Modules implemented in hardware include connected logic units such as gates and flip-flops, and/or may include programmable units, such as programmable gate arrays or processors.

Generally, the modules described herein refer to logical modules that may be combined with other modules or divided into sub-modules despite their physical organization or storage. The modules are executed by one or more computing systems and may be stored on or within any suitable computer readable medium or implemented in-whole or in-part within special designed hardware or firmware. Not all calculations, analysis, and/or optimization require the use of computer systems, though any of the above-described methods, calculations, processes, or analyses may be facilitated through the use of computers. Further, in some embodiments, process blocks described herein may be altered, rearranged, combined, and/or omitted.

The computer system 7202 includes one or more processing units (CPU) 7206, which may comprise a microprocessor. The computer system 7202 further includes a physical memory 7210, such as random access memory (RAM) for temporary storage of information, a read only memory (ROM) for permanent storage of information, and a mass storage device 7204, such as a backing store, hard drive, rotating magnetic disks, solid state disks (SSD), flash memory, phase-change memory (PCM), 3D XPoint memory, diskette, or optical media storage device. Alternatively, the mass storage device may be implemented in an array of servers. Typically, the components of the computer system 7202 are connected to the computer using a standards-based bus system. The bus system can be implemented using various protocols, such as Peripheral Component Interconnect (PCI), Micro Channel, SCSI, Industrial Standard Architecture (ISA) and Extended ISA (EISA) architectures.

The computer system 7202 includes one or more input/output (I/O) devices and interfaces 7212, such as a keyboard, mouse, touch pad, and printer. The I/O devices and interfaces 7212 can include one or more display devices, such as a monitor, that allows the visual presentation of data to a user. More particularly, a display device provides for the presentation of GUIs as application software data, and multi-media presentations, for example. The I/O devices and interfaces 7212 can also provide a communications interface to various external devices. The computer system 7202 may comprise one or more multi-media devices 7208, such as speakers, video cards, graphics accelerators, and microphones, for example.

The computer system 7202 may run on a variety of computing devices, such as a server, a Windows server, a Structure Query Language server, a Unix Server, a personal computer, a laptop computer, and so forth. In other embodiments, the computer system 7202 may run on a cluster computer system, a mainframe computer system and/or other computing system suitable for controlling and/or communicating with large databases, performing high volume transaction processing, and generating reports from large databases. The computing system 7202 is generally controlled and coordinated by an operating system software, such as z/OS, Windows, Linux, UNIX, BSD, SunOS, Solaris, MacOS, or other compatible operating systems, including proprietary operating systems. Operating systems control and schedule computer processes for execution, perform memory management, provide file system, networking, and I/O services, and provide a user interface, such as a graphical user interface (GUI), among other things.

The computer system 7202 illustrated in FIG. 72 is coupled to a network 7218, such as a LAN, WAN, or the Internet via a communication link 7216 (wired, wireless, or a combination thereof). Network 7218 communicates with various computing devices and/or other electronic devices. Network 7218 is communicating with one or more computing systems 7220 and one or more data sources 7222. The smoking system or device control module 7214 may access or may be accessed by computing systems 7220 and/or data sources 7222 through a web-enabled user access point. Connections may be a direct physical connection, a virtual connection, and other connection type. The web-enabled user access point may comprise a browser module that uses text, graphics, audio, video, and other media to present data and to allow interaction with data via the network 7218.

Access to the smoking system or device control module 7214 of the computer system 7202 by computing systems 7220 and/or by data sources 7222 may be through a web-enabled user access point such as the computing systems' 7220 or data source's 7222 personal computer, cellular phone, smartphone, laptop, tablet computer, e-reader device, audio player, or another device capable of connecting to the network 7218. Such a device may have a browser module that is implemented as a module that uses text, graphics, audio, video, and other media to present data and to allow interaction with data via the network 7218.

The output module may be implemented as a combination of an all-points addressable display such as a cathode ray tube (CRT), a liquid crystal display (LCD), a plasma display, or other types and/or combinations of displays. The output module may be implemented to communicate with input devices 7212 and they also include software with the appropriate interfaces which allow a user to access data through the use of stylized screen elements, such as menus, windows, dialogue boxes, tool bars, and controls (for example, radio buttons, check boxes, sliding scales, and so forth). Furthermore, the output module may communicate with a set of input and output devices to receive signals from the user.

The input device(s) may comprise a keyboard, roller ball, pen and stylus, mouse, trackball, voice recognition system, or pre-designated switches or buttons. The output device(s) may comprise a speaker, a display screen, a printer, or a voice synthesizer. In addition, a touch screen may act as a hybrid input/output device. In another embodiment, a user may interact with the system more directly such as through a system terminal connected to the score generator without communications over the Internet, a WAN, or LAN, or similar network.

In some embodiments, the system 7202 may comprise a physical or logical connection established between a remote microprocessor and a mainframe host computer for the express purpose of uploading, downloading, or viewing interactive data and databases on-line in real time. The remote microprocessor may be operated by an entity operating the computer system 7202, including the client server systems or the main server system, an/or may be operated by one or more of the data sources 7222 and/or one or more of the computing systems 7220. In some embodiments, terminal emulation software may be used on the microprocessor for participating in the micro-mainframe link.

In some embodiments, computing systems 7220 who are internal to an entity operating the computer system 7202 may access the smoking system or device control module 7214 internally as an application or process run by the CPU 7206.

In some embodiments, one or more features of the systems, methods, and devices described herein can utilize a URL and/or cookies, for example for storing and/or transmitting data or user information. A Uniform Resource Locator (URL) can include a web address and/or a reference to a web resource that is stored on a database and/or a server. The URL can specify the location of the resource on a computer and/or a computer network. The URL can include a mechanism to retrieve the network resource. The source of the network resource can receive a URL, identify the location of the web resource, and transmit the web resource back to the requestor. A URL can be converted to an IP address, and a Domain Name System (DNS) can look up the URL and its corresponding IP address. URLs can be references to web pages, file transfers, emails, database accesses, and other applications. The URLs can include a sequence of characters that identify a path, domain name, a file extension, a host name, a query, a fragment, scheme, a protocol identifier, a port number, a username, a password, a flag, an object, a resource name and/or the like. The systems disclosed herein can generate, receive, transmit, apply, parse, serialize, render, and/or perform an action on a URL.

A cookie, also referred to as an HTTP cookie, a web cookie, an internet cookie, and a browser cookie, can include data sent from a website and/or stored on a user's computer. This data can be stored by a user's web browser while the user is browsing. The cookies can include useful information for websites to remember prior browsing information, such as a shopping cart on an online store, clicking of buttons, login information, and/or records of web pages or network resources visited in the past. Cookies can also include information that the user enters, such as names, addresses, passwords, credit card information, etc. Cookies can also perform computer functions. For example, authentication cookies can be used by applications (for example, a web browser) to identify whether the user is already logged in (for example, to a web site). The cookie data can be encrypted to provide security for the consumer. Tracking cookies can be used to compile historical browsing histories of individuals. Systems disclosed herein can generate and use cookies to access data of an individual. Systems can also generate and use JSON web tokens to store authenticity information, HTTP authentication as authentication protocols, IP addresses to track session or identity information, URLs, and the like.

The computing system 7202 may include one or more internal and/or external data sources (for example, data sources 7222). In some embodiments, one or more of the data repositories and the data sources described above may be implemented using a relational database, such as DB2, Sybase, Oracle, CodeBase, and Microsoft® SQL Server as well as other types of databases such as a flat-file database, an entity relationship database, and object-oriented database, and/or a record-based database.

The computer system 7202 may also access one or more databases 7222. The databases 7222 may be stored in a database or data repository. The computer system 7202 may access the one or more databases 7222 through a network 7218 or may directly access the database or data repository through I/O devices and interfaces 7212. The data repository storing the one or more databases 7222 may reside within the computer system 7202.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. In addition, while several variations of the embodiments of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with, or substituted for, one another in order to form varying modes of the embodiments of the disclosed invention. Any methods disclosed herein need not be performed in the order recited. Thus, it is intended that the scope of the invention herein disclosed should not be limited by the particular embodiments described above.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. The headings used herein are for the convenience of the reader only and are not meant to limit the scope of the inventions or claims.

Further, while the methods and devices described herein may be susceptible to various modifications and alternative forms, specific examples thereof have been shown in the drawings and are herein described in detail. It should be understood, however, that the invention is not to be limited to the particular forms or methods disclosed, but, to the contrary, the invention is to cover all modifications, equivalents, and alternatives falling within the spirit and scope of the various implementations described and the appended claims. Further, the disclosure herein of any particular feature, aspect, method, property, characteristic, quality, attribute, element, or the like in connection with an implementation or embodiment can be used in all other implementations or embodiments set forth herein. Any methods disclosed herein need not be performed in the order recited. The methods disclosed herein may include certain actions taken by a practitioner; however, the methods can also include any third-party instruction of those actions, either expressly or by implication. The ranges disclosed herein also encompass any and all overlap, sub-ranges, and combinations thereof. Language such as "up to," "at least," "greater than," "less than," "between," and the like include the number recited. Numbers preceded by a term such as "about" or "approximately" include the recited numbers and should be interpreted based on the circumstances (e.g., as accurate as reasonably possible under the circumstances, for example ±5%, ±10%, ±15%, etc.). For example, "about 3.5 mm" includes "3.5 mm." Phrases preceded by a term such as "substantially" include the recited phrase and should be interpreted based on the circumstances (e.g., as much as reasonably possible under the circumstances). For example, "substantially constant" includes "constant." Unless stated otherwise, all measurements are at standard conditions including temperature and pressure.

What is claimed is:

1. An electronic smoking system for burning and smoking a combustible substance, the electronic smoking system comprising:

a removable combustible substance pod configured to contain the combustible substance, wherein the removable combustible substance pod is capable of being removed from and reinserted into the electronic smoking system, the combustible substance pod comprising:

a top end cap comprising a plurality of outlet air holes;

a bottom end cap comprising a plurality of inlet air holes; and a pod body comprising a top portion, a middle portion, and a bottom portion, wherein the top portion comprises threads for attaching the top end cap to the pod body, wherein the bottom portion comprises threads for attaching the bottom end cap to the pod body, and wherein the middle portion comprises at least two openings located closer to the bottom portion than the top portion of the pod body, wherein the at least two openings are configured to allow placement of at least two electrodes at least partially into the pod body through the at least two openings;

an electronic combustion device configured to ignite the combustible substance, the electronic combustion device comprising at least two electrodes placed at least partially within the combustible substance pod through the at least two openings located closer to the bottom portion of the pod body than the top portion of the pod body, wherein the at least two electrodes are configured to ignite the combustible substance contained within the combustible substance pod;

a battery;

an insulation wall located between the battery and the removable combustible substance pod, wherein the insulation wall is configured to control or prevent heat flow from the combustible substance pod to the battery; and a casing comprising a plurality of internal compartments for containing the combustible substance pod, the electronic combustion device, and the battery.

2. The electronic smoking system of claim 1, wherein the combustible substance pod further comprises a transparent housing configured to be inserted into the pod body.

3. The electronic smoking system of claim 1, wherein the pod body comprises one or more apertures configured to allow a user to view an internal volume of the pod body.

4. The electronic smoking system of claim 1, wherein the combustible substance is a loose-leaf product.

5. The electronic smoking system of claim 1, wherein the combustible substance pod comprises a fire-resistant material.

6. The electronic smoking system of claim 5, wherein the combustible substance pod comprises stainless steel, glass, or durable plastic.

7. The electronic smoking system of claim 1, wherein the pod body is transparent.

8. The electronic smoking system of claim 1, wherein the plurality of outlet air holes and the plurality of inlet air holes are large enough to allow air and smoke to enter and exit the combustible substance pod.

9. The electronic smoking system of claim 1, wherein the plurality of outlet air holes and the plurality of inlet air holes are small enough to prevent dislocation of solid loose-leaf products, combustible substances, or ash of a particular size.

10. The electronic smoking system of claim 1, further comprising a filter.

11. The electronic smoking system of claim 1, further comprising an ignition button configured to close an electronic circuit upon compression, wherein closing the electronic circuit activates the electronic combustion device.

12. The electronic smoking system of claim 11, wherein the electronic combustion device is configured to ignite the combustible substance substantially instantaneously upon compression of the ignition button.

13. The electronic smoking system of claim 11, wherein upon compression of the ignition button causes the at least two electrodes to be electrically discharged to ignite the combustible substance.

14. The electronic smoking system of claim 1, further comprising a charging port configured to charge the battery when connected to an external power source.

15. The electronic smoking system of claim 1, wherein the casing further comprises a top lid, the top lid comprising a mouthpiece for drawing smoke from the casing, wherein the smoke is generated from ignition of the combustible material.

16. The combustible substance pod device of claim 15, further comprising an air pathway from the plurality of outlet air holes of the top end cap of the combustible substance pod to the mouthpiece of the casing.

17. The electronic smoking system of claim 1, wherein the casing further comprises a bottom lid, the bottom lid comprising one or more air intake holes.

18. The combustible substance pod device of claim 17, further comprising an air pathway from the one or more air intake holes of the casing to the plurality of inlet air holes of the bottom end cap of the combustible substance pod.

19. The combustible substance pod device of claim 1, wherein the plurality of outlet air holes are adapted to allow air and smoke to exit the combustible substance pod, and wherein the plurality of inlet air holes are adapted to allow air to enter the combustible substance pod.

20. The combustible substance pod device of claim 1, wherein the pod body further comprises at least two top openings located closer to the top portion than the bottom portion of the pod body, wherein the at least two top openings are configured to allow placement of at least two electrodes at least partially into the pod body through the at least two top openings.

* * * * *